US011276385B2

(12) United States Patent
Tachi et al.

(10) Patent No.: US 11,276,385 B2
(45) Date of Patent: Mar. 15, 2022

(54) NOISE REDUCTION DEVICE, VEHICLE, NOISE REDUCTION SYSTEM, AND NOISE REDUCTION METHOD

(71) Applicant: ALPINE ELECTRONICS, INC., Tokyo (JP)

(72) Inventors: Ryosuke Tachi, Fukushima (JP); Keita Tanno, Tokyo (JP); Mone Isami, Tokyo (JP); Ryo Ito, Fukushima (JP); Haruki Uesugi, Fukushima (JP)

(73) Assignee: ALPINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 16/929,486

(22) Filed: Jul. 15, 2020

(65) Prior Publication Data

US 2021/0020156 A1 Jan. 21, 2021

(30) Foreign Application Priority Data

Jul. 16, 2019 (JP) ..... JP2019-131408

(51) Int. Cl.
*G10K 11/178* (2006.01)

(52) U.S. Cl.
CPC ..... *G10K 11/17853* (2018.01); *G10K 2210/1282* (2013.01)

(58) Field of Classification Search
None
See application file for complete search history.

(56) References Cited

U.S. PATENT DOCUMENTS

| | | | | |
|---|---|---|---|---|
| 2010/0027804 | A1 | 2/2010 | Kano | |
| 2016/0029111 | A1 * | 1/2016 | Wacquant ..... | H04R 3/005 381/71.4 |
| 2016/0093283 | A1 | 3/2016 | Kano | |
| 2018/0012589 | A1 | 1/2018 | MacNeille et al. | |

FOREIGN PATENT DOCUMENTS

| | | |
|---|---|---|
| EP | 2996111 | 3/2016 |
| JP | H06-027971 | 2/1994 |
| JP | H06-035484 | 2/1994 |
| JP | 2018-072770 | 5/2018 |

OTHER PUBLICATIONS

Extended European Search Report for 20186002.0 dated Dec. 14, 2020.

* cited by examiner

*Primary Examiner* — Kenny H Truong
(74) *Attorney, Agent, or Firm* — IPUSA, PLLC

(57) ABSTRACT

With respect to a noise reduction device using a speaker and a microphone corresponding to each seat in a vehicle to reduce a noise in each seat, the noise reduction device includes, a signal processing unit configured to generate a canceling sound that reduces a noise at an ear of an occupant in a predetermined seat by using an auxiliary filter, an operation setting unit configured to disable operations of a speaker and a microphone corresponding to each empty seat in the vehicle, and an auxiliary filter setting unit configured to change a setting value of the auxiliary filter used by the signal processing unit to generate the canceling sound in accordance with the number of occupants in seats other than the predetermined seat, the seats affecting the noise in the predetermined seat.

9 Claims, 13 Drawing Sheets

NOISE REDUCTION DEVICE, VEHICLE, NOISE REDUCTION SYSTEM, AND NOISE REDUCTION METHOD

CROSS-REFERENCE TO RELATED APPLICATIONS

This application is based on and claims priority to Japanese Patent Application No. 2019-131408, filed on Jul. 16, 2019, the entire contents of which are incorporated herein by reference.

BACKGROUND OF THE INVENTION

1. Field of the Invention

The disclosures herein relate to a noise reduction device, a vehicle, a noise reduction system, and a noise reduction method.

2. Description of the Related Art

As a technique for controlling noise in a vehicle, such as a car, there is active noise control (ANC) that reduces, for example, engine noise of a vehicle. Additionally, demand for active cross talk control (ACTC), which plays a different content at each seat in a vehicle by the technique of the ANC being applied, is increasing.

As a technique related to the above, an active noise cancelling device that can reduce a noise even though a sound field of an installed environment varies when an error microphone cannot be installed at a desired noise control position when used, has been known (see Patent Document 1).

In the ANC or the ACTC, when an adaptive filter is used to reduce a broadband noise, it is common to use the feedforward type, but the noise may not be sufficiently reduced when a microphone is away from ears because the noise is reduced at a position of the microphone.

With respect to the above, the technique disclosed in Patent Document 1 achieves noise reduction at the position of the ear by virtually obtaining an audio signal at the position of the ear by using an auxiliary filter generated in advance.

RELATED-ART DOCUMENTS

Patent Documents

Patent Document 1: Japanese Laid-Open Patent Publication No. 2018-072770

SUMMARY OF THE INVENTION

According to an embodiment of the present invention, a noise reduction device using a speaker and a microphone corresponding to each seat in a vehicle to reduce a noise in each seat, the noise reduction device includes, a signal processing unit configured to generate a canceling sound that reduces a noise at an ear of an occupant in a predetermined seat by using an auxiliary filter, an operation setting unit configured to disable operations of a speaker and a microphone corresponding to each empty seat in the vehicle, and an auxiliary filter setting unit configured to change a setting value of the auxiliary filter used by the signal processing unit to generate the canceling sound in accordance with the number of occupants in seats other than the predetermined seat, the seats affecting the noise in the predetermined seat.

According to at least one embodiment of the present invention, in a noise reduction system in which a speaker and a microphone corresponding to each seat of a vehicle are used to reduce a noise in each seat, the noise reduction effect can be improved while the output of the speaker of the empty seat is disabled.

DESCRIPTION OF THE EMBODIMENTS

It can be considered that a noise reduction system that plays a different content at each seat in a vehicle is achieved by a technique that uses an auxiliary filter generated in advance to reduce a noise at an ear of an occupant in each seat.

In such a noise reduction system, when there is an empty seat in which no occupant is present in the vehicle, it is desired to disable the output of a speaker provided for the seat. It can be expected that this produces an effect that reduces the power consumption of the noise reduction device and suppresses generation of a noise to other seats.

In practice, however, it is found that there is a problem that disabling the output of the speaker of the empty seat changes a characteristic of a primary path included in the auxiliary filter, thereby degrading the noise reduction effect.

One embodiment of the present invention has been made in view of the above-described problem and, in a noise reduction system in which a speaker and a microphone corresponding to each seat of a vehicle are used to reduce the noise in each seat, the noise reduction effect is improved while the output of the speaker of the empty seat is disabled.

In the following, an embodiment of the present invention will be described with reference to the accompanying drawings.

<System Configuration>

Figure 1:
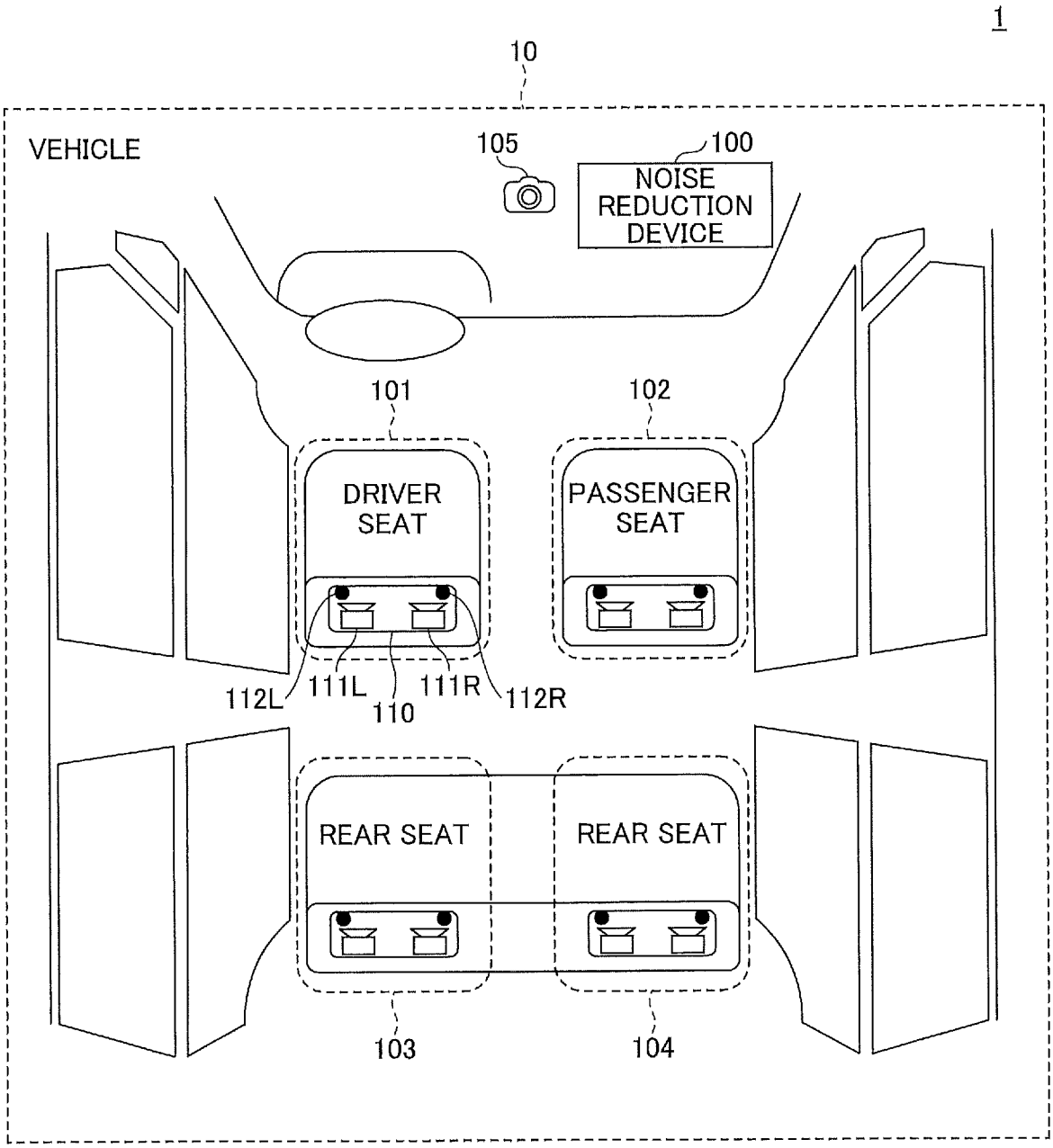
FIG. 1 is a drawing illustrating an example of a system configuration of a noise reduction system according to an embodiment.

FIG. 1 is a drawing illustrating an example of a system configuration of a noise reduction system according to an embodiment. A noise reduction system 1 includes, for example, a noise reduction device 100 mounted to a vehicle 10, such as a car, and speakers 111L and 111R and microphones 112L and 112R that are provided corresponding to each seat in the vehicle 10. The noise reduction system 1 includes a camera 105, a seat sensor, or the like used to determine whether an occupant is present in each seat in the vehicle 10.

In the example of FIG. 1, a headrest 110 of a driver seat 101 is equipped with the speakers 111L and 111R and the microphones 112L and 112R corresponding to the driver seat 101, for example. The headrest 110 of each of a passenger seat 102, a rear seat 103, and a rear seat 104 is also equipped with the speakers 111L and 111R and the microphones 112L and 112R corresponding to each seat.

A speaker 111L (a first speaker) and a microphone 112L (a first microphone) corresponding to each seat are positioned near a left ear of the occupant seated in each seat. A speaker 111R (a second speaker) and a microphone 112R (a second microphone) corresponding to each seat are positioned near a right ear of the occupant seated in each seat.

The noise reduction device 100 is coupled to the speakers 111L and 111R and the microphones 112L and 112R of each seat, and outputs a canceling sound of the same amplitude and inverted phase with respect to a noise in each seat to achieve an active noise control (ANC) that reduces the noise. For example, the noise reduction device 100 generates and outputs a canceling sound (a first canceling sound) for reducing the noise at the left ear of the occupant seated in each seat and a canceling sound (a second canceling sound) for reducing the noise at the right ear of the occupant seated in each seat.

Preferably, the noise reduction device 100 supports an active cross talk control (ACTC) that plays a different content (e.g., music, voice, ambient sound, and so on) in each seat in the vehicle 10. Thus, even when the content, such as a movie, is played, for example, in the rear seats 103 and 104, an influence of the sound of the movie or the like being played is reduced and the driver can enjoy another content, such as music, in the driver seat 101.

(Virtual Sensing)

Figure 13A:
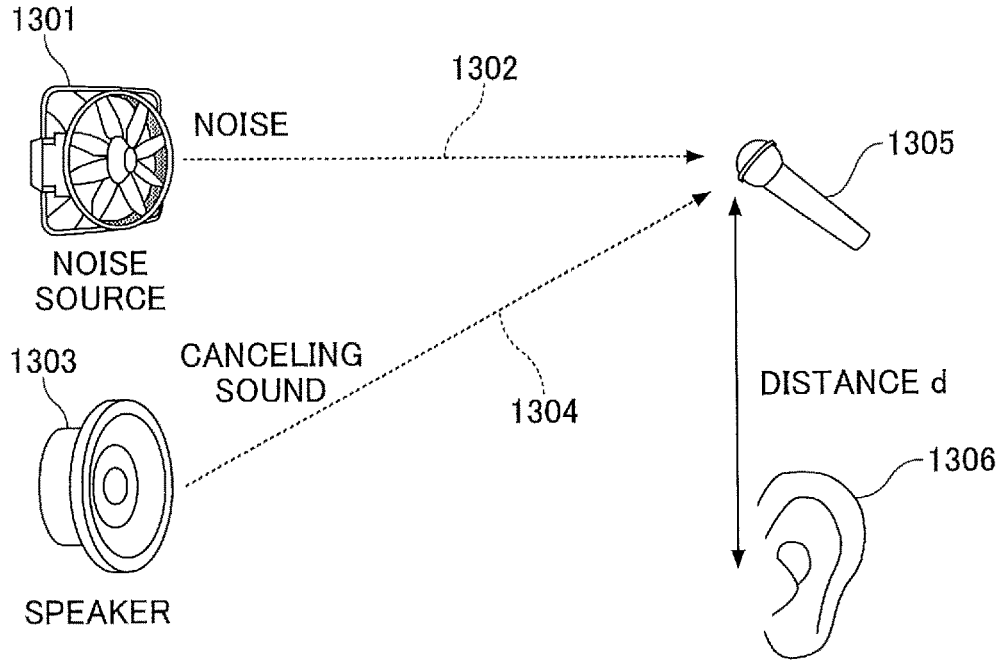
FIG. 13A and FIG. 13B are drawings illustrating an image of virtual sensing.

A typical ANC system obtains a noise 1302 output from a noise source 1301 by a microphone 1305 to produce a canceling noise 1304 that cancels the noise, as illustrated in FIG. 13A, for example. The ANC system outputs the generated canceling noise 1304 from the speaker 1303 to cancel the noise at a point of the microphone 1305. Thus, for example, as illustrated in FIG. 13A, if a distance d between the microphone 1305 and an ear 1306 is large, there are cases where the noise cannot be sufficiently reduced.

Figure 13B:
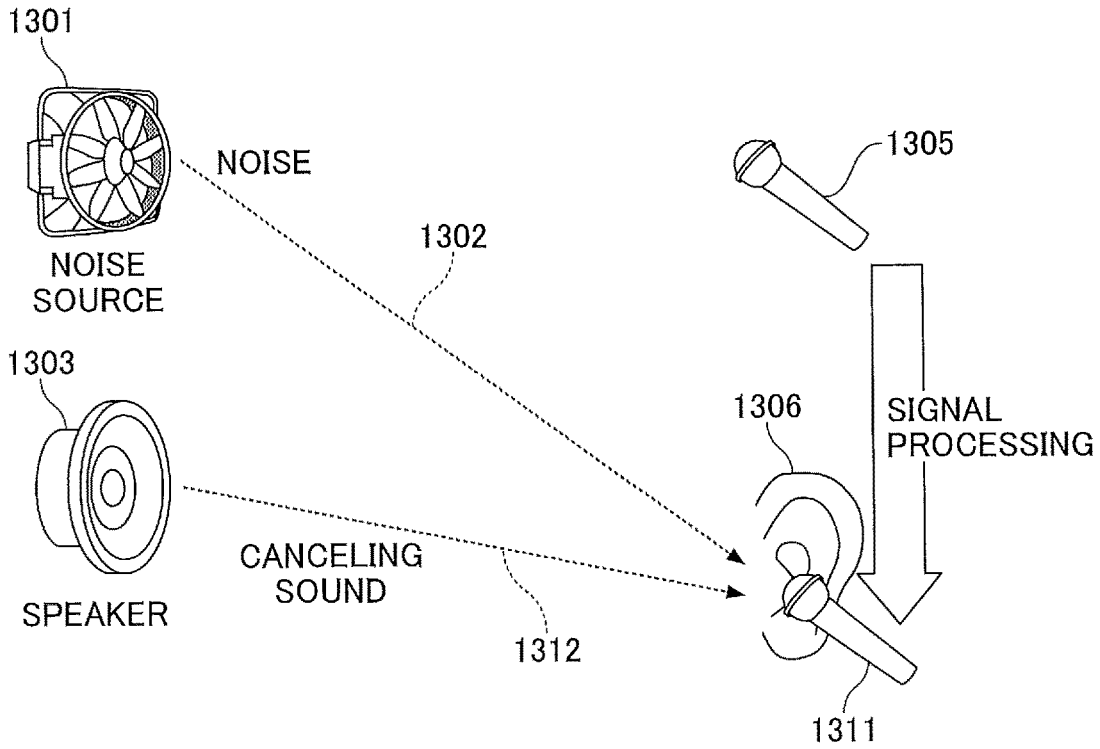

In the present embodiment, a virtual sensing technique, in which an auxiliary filter learned using a dummy head in advance, for example, is used to perform signal processing such that the virtual microphone 1311 is positioned at the ear 1306, is used as illustrated in FIG. 13B, for example. This enables the noise reduction device 100 to generate a canceling sound 1312 that cancels the noise at the ear of the occupant using, for example, an auxiliary filter generated in advance. The noise reduction device 100 can cancel the noise at a point of the virtual microphone 1311, that is, near the ear 1306 by outputting the generated canceling sound 1312 from the speaker 1303.

(Process Overview)

In the present embodiment, a similar noise reduction process is performed in each seat. Here, as an example, a process in which the noise in the driver seat 101 is reduced, will be mainly described. The following description assumes that sounds (i.e., contents) output from the speakers 111L and 111R of the rear seats 103 and 104 are noise sources that affect the noise in the driver seat 101.

The speakers 111L and 111R of the passenger seat 102 have, for example, forward directivity and emit little sounds to the side. Thus, the sounds output from the speakers 111L and 111R of the passenger seat 102 are negligible (or a small influence) to the noise in the driver seat 101.

The noise reduction device 100 according to the present embodiment has a function to determine whether the occupant is present in each seat based on an image inside the vehicle 10 taken by, for example, the camera 105, and disable operations of the speaker and the microphone corresponding to the empty seat.

For example, the noise reduction device 100 disables (e.g., mute) the speakers 111L and 111R and the microphones 112L and 112R corresponding to the rear seat 104 when no occupant is present in the rear seat 104 to stop the noise reduction process for the rear seat 104. The noise reduction device 100 enables (e.g., unmute) the speakers 111L and 111R and microphones 112L and 112R corresponding to the rear seat 104 when the occupant is present in the rear seat 104 to perform the noise reduction process for the rear seat 104.

This enables the noise reduction device 100 to reduce the power consumption required for the noise reduction process of the empty seat (e.g., the rear seat 104) and also to stop the output of the content that is a noise source for another seat (e.g., the driver seat 101).

In practice, however, it has been found that disabling the speaker output of the rear seat 104 in which no occupant is present changes the characteristic of the primary path included in the auxiliary filter, for example, and the noise reduction effect of the driver seat 101 is degraded.

Thus, the noise reduction device 100 has a function to change the auxiliary filter used to generate the canceling sound that reduces the noise in the driver seat 101 in accordance with the number of occupants in the rear seats 103 and 104, which are seats other than the driver seat 101, affecting the noise in the driver seat 101.

For example, the noise reduction device 100 performs a learning process while the speakers 111L and 111R and the microphones 112L and 112R corresponding to the rear seats 103 and 104 that affect the noise in the driver seat 101 are enabled, and stores an obtained auxiliary filter (an auxiliary filter A).

The noise reduction device 100 performs a learning process while the speaker and the microphone corresponding to either the rear seat 103 or the rear seat 104 (e.g., the rear seat 104) that affects the noise in the driver seat 101 are disabled, and stores an obtained auxiliary filter (an auxiliary filter B).

Additionally, the noise reduction device 100 applies the auxiliary filter A stored in advance to generate a canceling sound that reduces the noise in the driver seat 101 when an occupant is present in each of the rear seats 103 and 104 that affect the noise in the driver seat 101.

With respect to the above, the noise reduction device 100 applies the auxiliary filter B stored in advance to generate a canceling sound that reduces the noise in the driver seat 101 when no occupant is present in either the rear seat 103 or the rear seat 104 that affects the noise in the driver seat 101.

When no occupants are present in both of the rear seats 103 and 104 that affect the noise in the driver seat 101, the noise reduction device 100 may stop the noise reduction process in the driver seat 101, for example, because there is no noise source that affects the noise in the driver seat 101.

If only the output of the speakers 111L and 111R is disabled in the empty seat, a loud noise (an explosive sound) may be generated when the output of the speaker is enabled again because the adaptive filter has been adapted to the empty seat.

Therefore, the noise reduction device 100 according to the present embodiment disables the inputs of the microphones 112L and 112R in addition to the outputs of the speakers 111L and 111R in the empty seat to prevent improper adaptation.

In the above description, a case in which the noise in the driver seat 101 is reduced, has been described. However, the noise reduction device 100 can perform a similar process in each seat of the vehicle 10.

For example, when the noise reduction device 100 reduces the noise in the passenger seat 102, the sounds (i.e., the contents) output from the speakers 111L and 111R in the rear seats 103 and 104 are noise sources that affect the noise in the passenger seat 102. Thus, the noise reduction device 100 only needs to change the auxiliary filter used to generate a canceling sound that reduces the noise in the passenger seat 102 in accordance with the number of occupants in the rear seats 103 and 104, which are seats other than the passenger seat 102, affecting the noise in the passenger seat 102.

When the noise reduction device 100 reduces the noise in the rear seat (e.g., the rear seat 103), the sounds (i.e., the contents) output from the speakers 111L and 111R of the driver seat 101 and the passenger seat 102 are noise sources affecting the noise in the rear seat. Thus, the noise reduction device 100 only needs to change the auxiliary filter used to generate a canceling sound that reduces the noise in the rear seat in accordance with the number of occupants in the driver seat 101 and the passenger seat 102, which are seats other than the rear seat, affecting the noise in the rear seat.

The system configuration of the noise reduction system 1 illustrated in FIG. 1 is an example. For example, the speakers 111L and 111R or the microphones 112L and 112R corresponding to each seat in the vehicle 10 may be provided outside the headrest 110. The noise reduction device 100 may determine whether an occupant is present in each seat based on, for example, information obtained from an on-board electronic control unit (ECU) mounted to the vehicle 10 or a signal output from a seat sensor, instead of the image taken by the camera 105.

<Configuration Example of the Noise Reduction Device>

Figure 2:
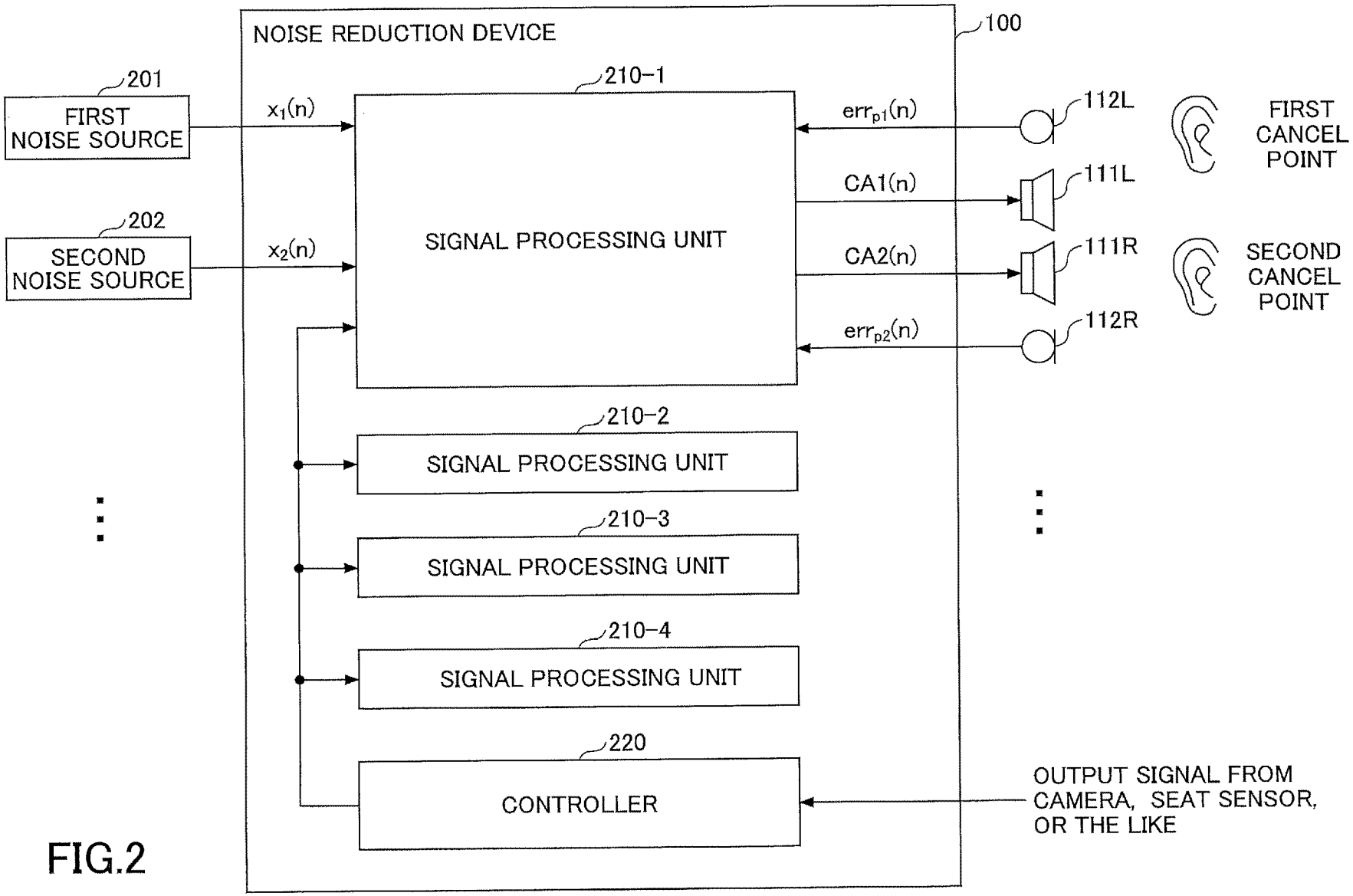
FIG. 2 is a drawing illustrating a configuration example of the noise reduction system according to the embodiment.

FIG. 2 is a drawing illustrating a configuration example of the noise reduction system according to the embodiment. In FIG. 2, for ease of explanation, only a configuration in which the noise reduction device 100 reduces the noise in each seat in the vehicle 10, is illustrated. A configuration in which the noise reduction device 100 outputs the content, such as music and voice, will be described later with reference to FIG. 11.

The noise reduction device 100 includes signal processing units 210-1 to 210-4 corresponding to respective seats in the vehicle 10, and a controller 220. For example, the signal processing unit 210-1 performs the noise reduction process in the driver seat 101 of FIG. 1, and the signal processing unit 210-2 performs the noise reduction processing in the passenger seat 102. The signal processing unit 210-3 performs the noise reduction process in the rear seat 103 of FIG. 1, and the signal processing unit 210-4 performs the noise reduction processing in the rear seat 104, for example.

Since configurations of the signal processing units 210-1 to 210-4 are common, one signal processing unit 210 (e.g., the signal processing unit 210-1) will be described here. In the following description, when a given signal processing unit among the signal processing units 210-1 to 210-4 is indicated, a "signal processing unit 210" is used.

In FIG. 2, a noise source, speakers, and microphones corresponding to each of the signal processing units 210 are coupled to each of the signal processing units 210-2 to 210-4, in a manner similar to the signal processing unit 210-1.

The signal processing units 210-1 to 210-4 are implemented, for example, by a digital signal processor (DSP) provided by the noise reduction device 100 and perform noise reduction processing in respective seats in the vehicle 10 by the following control from the controller 220.

A noise signal $x_1(n)$ generated by a first noise source 201 and a noise signal $x_2(n)$ generated by a second noise source 202 are input to the signal processing unit 210. The noise signal $x_1(n)$ and the noise signal $x_2(n)$ correspond to a reference signal in the ANC.

For example, a content signal, such as music, output in the rear seat 103 is input, as the noise signal $x_1(n)$, to the signal processing unit 210-1 that performs the noise reduction process in the driver seat 101 and a content signal output in the rear seat 104 is input as the noise signal $x_2(n)$.

An error signal $err_{p1}(n)$ output from the microphone 112L and the error signal $err_{p2}(n)$ output from the microphone 112R are input to the signal processing unit 210.

The signal processing unit 210 uses the noise signal $x_1(n)$, the noise signal $x_2(n)$, the error signal $err_{p1}(n)$, and the error signal $err_{p2}(n)$ to generate a cancellation signal CA1(*n*) that cancels the noise at a first cancel point. The signal processing unit 210 outputs the generated cancellation signal CA1(*n*) from the speaker 111L to reduce the noise at the first cancel point (for example, the left ear of the occupant).

Similarly, the signal processing unit 210 uses the noise signal $x_1(n)$, the noise signal $x_2(n)$, the error signal $err_{p1}(n)$, and the error signal $err_{p2}(n)$ to generate a cancellation signal CA2(*n*) that cancels the noise at a second cancel point. The signal processing unit 210 outputs the generated cancellation signal CA2(*n*) from the speaker 111R to reduce the noise at the second cancel point (e.g., the right ear of the occupant). A specific configuration example of the signal processing unit will be described later with reference to FIG. 3.

The controller 220 is a computer for controlling an entirety of the noise reduction device 100 and includes, for example, a central processing unit (CPU), a memory, a storage device, and a communication interface (I/F). The controller 220 executes a predetermined program to achieve a functional configuration that will be described later in FIG. 4.

(Configuration Example of the Signal Processing Unit)

Figure 3:
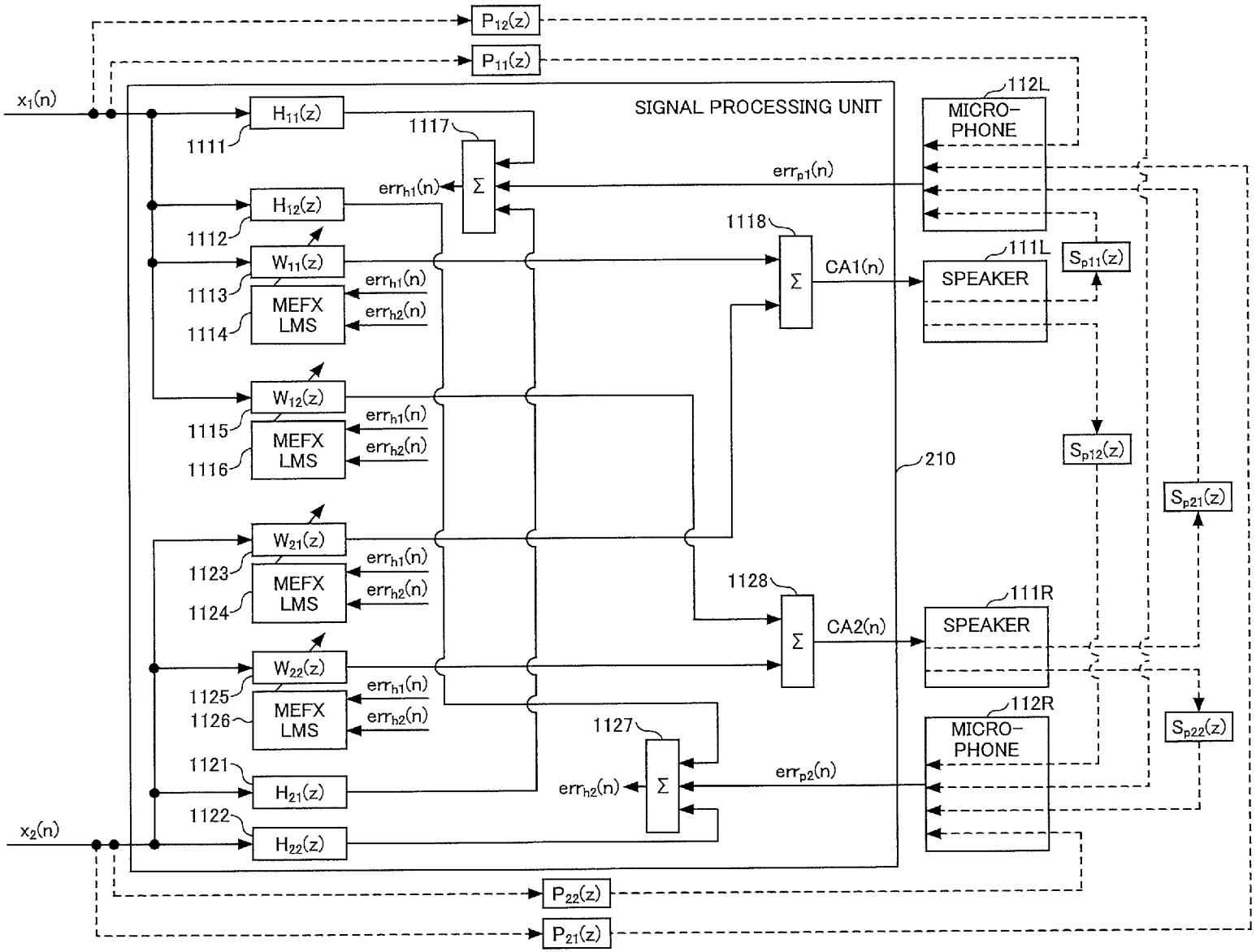
FIG. 3 is a drawing illustrating a configuration example of a signal processing unit according to the embodiment.

FIG. 3 is a drawing illustrating a configuration example of the signal processing unit according to the embodiment. The signal processing unit 210 includes a first system for mainly performing a process related to the first cancel point and a second system for mainly performing a process related to the second cancel point.

As illustrated in FIG. 3, the signal processing unit 210 includes a first auxiliary filter 1111 of the first system in which a transfer function $H_{11}(z)$ is set, a first auxiliary filter 1112 of the second system in which a transfer function $H_{12}(z)$ is set, a first variable filter 1113 of the first system, a first adaptive algorithm execution unit 1114 of the first system, a first variable filter 1115 of the second system, a first adaptive algorithm execution unit 1116 of the second system, an error correction adding unit 1117 of the first system, and a canceling sound generation adding unit 1118 of the first system.

The first variable filter 1113 of the first system and the first adaptive algorithm execution unit 1114 of the first system constitute an adaptive filter, and the first adaptive algorithm execution unit 1114 of the first system updates a transfer function $W_{11}(z)$ of the first variable filter 1113 of the first system by using the Multiple Error Filtered X Least Mean Squares (MEFX LMS) algorithm. The first variable filter 1115 of the second system and the first adaptive algorithm execution unit 1116 of the second system constitute an adaptive filter, and the first adaptive algorithm execution unit 1116 of the second system updates a transfer function $W_{12}(z)$ of the first variable filter 1115 of the second system by using the MEFX LMS algorithm.

The signal processing unit 210 includes a second auxiliary filter 1121 of the first system in which the transfer function $H_{21}(z)$ is set in advance, a second auxiliary filter 1122 of the second system in which a transfer function $H_{22}(z)$ is set in advance, a second variable filter 1123 of the first system, a second adaptive algorithm execution unit 1124 of the first system, a second variable filter 1125 of the second system, a second adaptive algorithm execution unit 1126 of the second system, an error correction adding unit 1127 of the second system, and a canceling sound generation adding unit 1128 of the second system.

The second variable filter 1123 of the first system and the second adaptive algorithm execution unit 1124 of the first system constitute an adaptive filter, and the second adaptive algorithm execution unit 1124 of the first system updates a transfer function $W_{21}(z)$ of the second variable filter 1123 of the first system by using the MEFX LMS algorithm.

The second variable filter 1125 of the second system and the second adaptive algorithm execution unit 1126 of the second system constitute an adaptive filter, and the second adaptive algorithm execution unit 1126 of the second system updates a transfer function $W_{22}(z)$ of the second variable filter 1125 of the second system by using the MEFX LMS algorithm.

In such a configuration, the noise signal $x_1(n)$ input to the signal processing unit 210 is sent to the first auxiliary filter 1111 of the first system, the first auxiliary filter 1112 of the second system, the first variable filter 1113 of the first system, and the first variable filter 1115 of the second system.

The error signal $err_{p1}(n)$ input from the microphone 112L is sent to the error correction adding unit 1117 of the first system, and the error signal $err_{p2}(n)$ input from the microphone 112R is sent to the error correction adding unit 1127 of the second system.

The output of the first auxiliary filter 1111 of the first system is sent to the error correction adding unit 1117 of the first system, and the output of the first auxiliary filter 1112 of the second system is sent to the error correction adding unit 1127 of the second system. The output of the first variable filter 1113 of the first system is sent to the canceling sound generation adding unit 1118 of the first system, and the output of the first variable filter 1115 of the second system is sent to the canceling sound generation adding unit 1128 of the second system.

The noise signal $x_2(n)$ input to the signal processing unit 210 is sent to the second auxiliary filter 1121 of the first system, the second auxiliary filter 1122 of the second system, the second variable filter 1123 of the first system, and the second variable filter 1125 of the second system.

The output of the second auxiliary filter 1121 of the first system is sent to the error correction adding unit 1117 of the first system, and the output of the second auxiliary filter 1122 of the second system is sent to the error correction adding unit 1127 of the second system. The output of the second variable filter 1123 of the first system is sent to the canceling sound generation adding unit 1118 of the first system, and the output of the second variable filter 1125 of the second system is sent to the canceling sound generation adding unit 1128 of the second system.

The error correction adding unit 1117 of the first system adds the output of the first auxiliary filter 1111 of the first system, the output of the second auxiliary filter 1121 of the first system, and the error signal $err_{p1}(n)$ to generate an error signal $err_{h1}(n)$. The error correction adding unit 1127 of the second system adds the output of the first auxiliary filter 1112 of the second system, the output of the second auxiliary filter 1122 of the second system, and the error signal $err_{p2}(n)$ to generate an error signal $err_{h2}(n)$.

Then, the error signal $err_{h1}(n)$ and the error signal $err_{h2}(n)$ are output, as multiple errors, to the first adaptive algorithm execution unit 1114 of the first system, the first adaptive algorithm execution unit 1116 of the second system, the second adaptive algorithm execution unit 1124 of the first system, and the second adaptive algorithm execution unit 1126 of the second system.

The canceling sound generation adding unit 1118 of the first system adds the output of the first variable filter 1113 of the first system and the output of the second variable filter 1123 of the first system to generate a first cancellation signal CA1($n$) and outputs the first cancellation signal CA1($n$) from the speaker 111L. The canceling sound generation adding unit 1128 of the second system adds the output of the first variable filter 1115 of the second system and the output of the second variable filter 1125 of the second system to generate a second cancellation signal CA2($n$) and outputs the second cancellation signal CA2($n$) from the speaker 111R.

The first adaptive algorithm execution unit 1114 of the first system updates the transfer function $W_{11}(z)$ of the first variable filter 1113 of the first system by using the MEFX LMS algorithm so that the error signal $err_{h1}(n)$ and the error signal $err_{h2}(n)$ input as multiple errors are zero. The first adaptive algorithm execution unit 1116 of the second system updates the transfer function $W_{12}(z)$ of the first variable filter 1115 of the second system by using the MEFX LMS algorithm so that the error signal $err_{h1}(n)$ and the error signal $err_{h2}(n)$ input as multiple errors become zero.

Further, the second adaptive algorithm execution unit 1124 of the first system updates the transfer function $W_{21}(z)$ of the second variable filter 1123 of the first system by using the MEFX LMS algorithm so that the error signal $err_{h1}(n)$ and the error signal $err_{h2}(n)$ input as multiple errors become zero. The second adaptive algorithm execution unit 1126 of the second system updates the transfer function $W_{22}(z)$ of the second variable filter 1125 of the second system by using the MEFX LMS algorithm so that the error signal $err_{h1}(n)$ and the error signal $err_{h2}(n)$ input as multiple errors are zero.

The transfer function $H_{11}(z)$ of the first auxiliary filter 1111 of the first system, the transfer function $H_{12}(z)$ of the first auxiliary filter 1112 of the second system, the transfer function $H_{21}(z)$ of the second auxiliary filter 1121 of the first system, and the transfer function $H_{22}(z)$ of the second auxiliary filter 1122 of the second system in the signal processing unit 210 can be determined by the learning process described below.

In the present embodiment, a combination of the first auxiliary filter 1111 of the first system, the first auxiliary filter 1112 of the second system, the second auxiliary filter 1121 of the first system, and the second auxiliary filter 1122 of the second system is referred to as "auxiliary filters". The transfer functions $H_{11}(z)$, $H_{12}(z)$, $H_{21}(z)$, and $H_{22}(z)$ of the auxiliary filters are referred to as "setting values of the auxiliary filters".

(Functional Configuration of the Controller)

Figure 4:
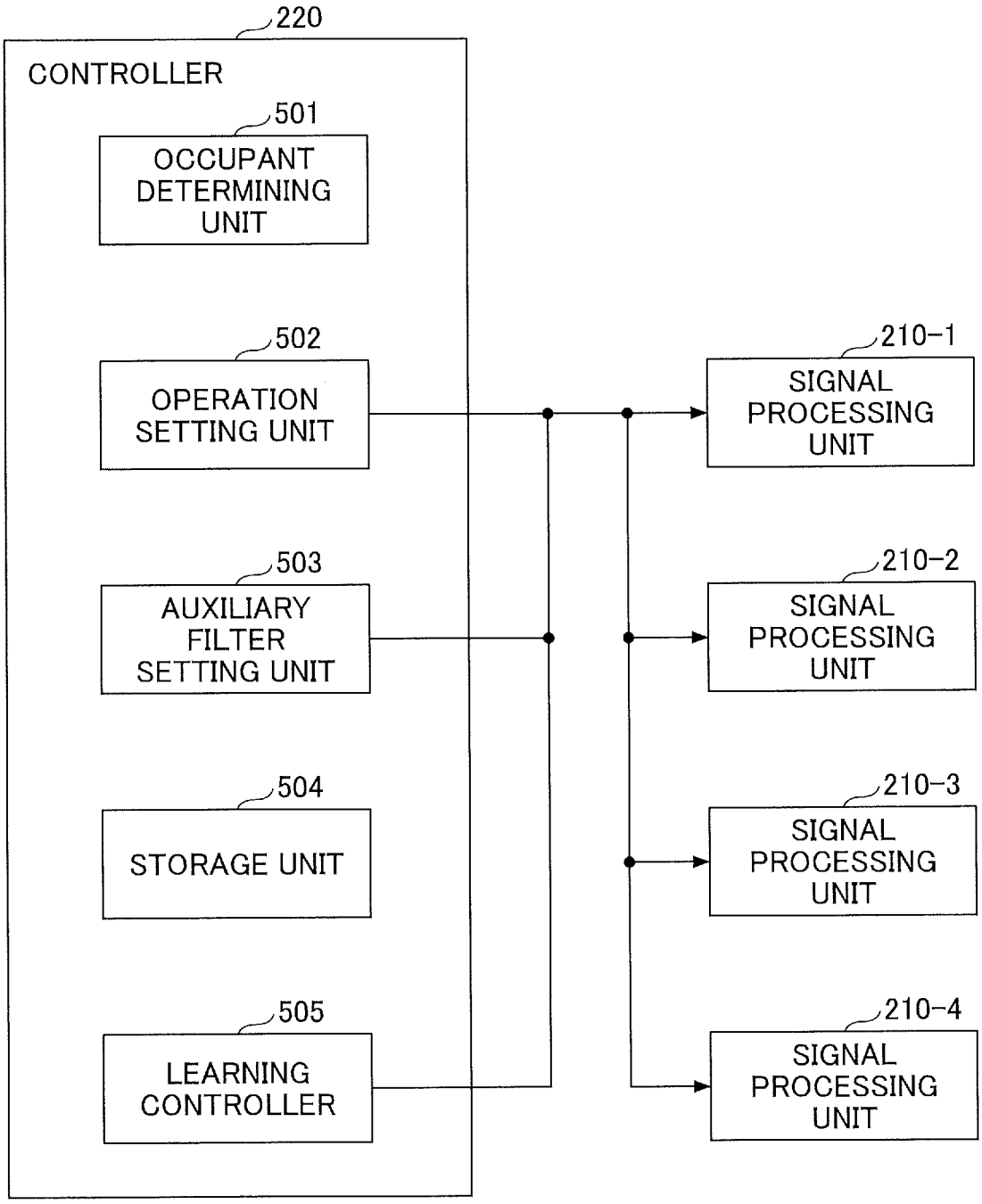
FIG. 4 is a drawing illustrating a functional configuration example of a controller according to the embodiment.

FIG. 4 is a drawing illustrating a functional configuration example of the controller according to the embodiment. The controller 200, for example, executes a predetermined program by the CPU provided in the controller 200 to achieve an occupant determining unit 501, an operation setting unit 502, an auxiliary filter setting unit 503, a storage unit 504, and a learning controller 505. At least a portion of elements of the above-described functional configuration may be implemented by hardware.

The occupant determining unit 501 determines whether an occupant is present in each seat in the vehicle 10. For example, the occupant determining unit 501 analyzes an image inside the vehicle 10 taken by the camera 105 to determine whether an occupant is present in each of the driver seat 101, the passenger seat 102, the rear seat 103, and the rear seat 104.

However, the present invention is not limited to this. The occupant determining unit 501 may obtain an output signal from a seat sensor or the like provided in the vehicle 10 to determine whether an occupant is present in each seat in the vehicle 10. Alternatively, the occupant determining unit 501 may determine whether an occupant is present in each seat in the vehicle 10 based on information obtained from the on-board ECU or the like mounted to the vehicle 10.

The operation setting unit 502 controls the signal processing units 210-1 to 210-4 to disable (e.g., mute) the speakers 111L and 111R and the microphones 112L and 112R corresponding to each seat in which the occupant determining unit 501 determines that no occupant is present. The operation setting unit 502 controls the signal processing units 210-1 to 210-4 to enable (e.g., unmute) the speakers 111L and 111R and microphones 112L and 112R corresponding to each seat in which the occupant determining unit 501 determines that an occupant is present.

Figure 5B:
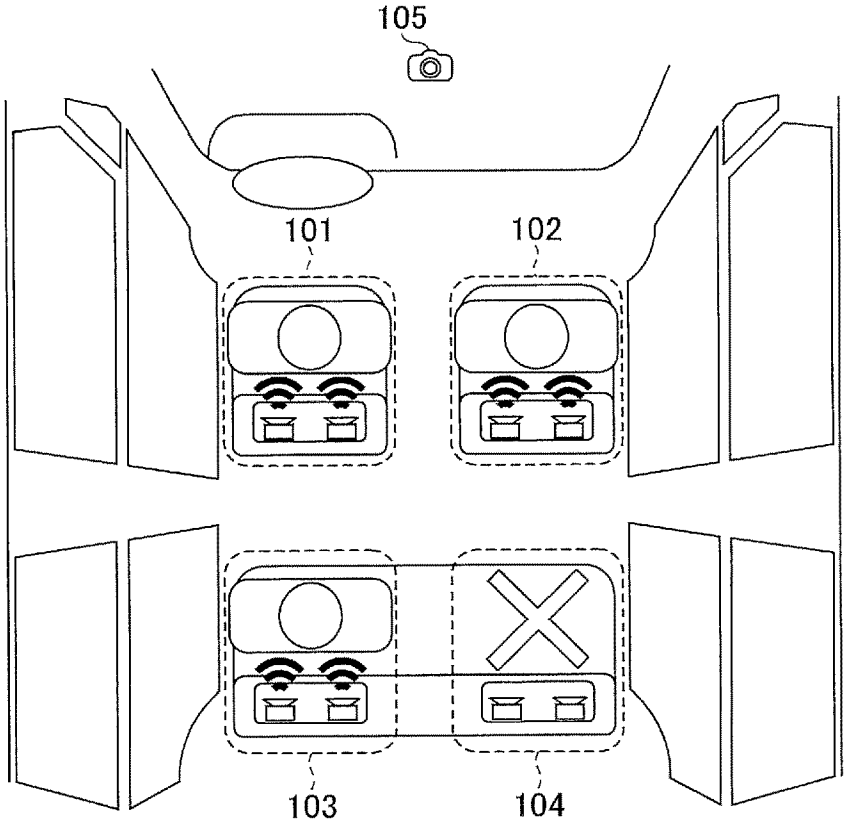
FIG. 5A and FIG. 5B are drawings for describing an overview of the noise reduction system according to the embodiment.
Figure 5A:
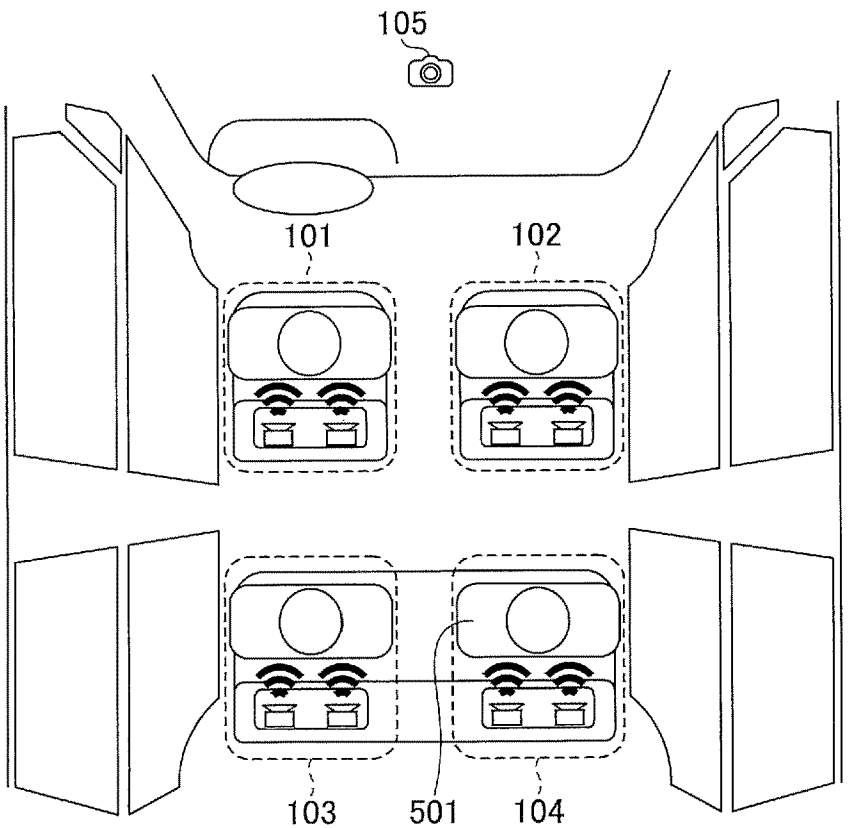

As illustrated in FIG. 5A, the operation setting unit 502 maintains a state in which the speaker and microphone corresponding to each seat are enabled when an occupant is present in each seat of the vehicle 10, for example. As illustrated in FIG. 5B, the operation setting unit 502 disables the speaker and microphone corresponding to the rear seat 104 when an occupant of the rear seat 104 gets out of the vehicle, for example.

When an occupant rides in the rear seat 104 in which no occupant had been seated as illustrated in FIG. 5B, the operation setting unit 502 enables an operation of the speaker corresponding to the rear seat 104 in which the occupant rides, for example. Further, the operation setting unit 502 enables the speaker and microphone corresponding to the rear seat 104 in the order of the speaker and the microphone. Alternatively, the operation setting unit 502 may simultaneously enable the speaker and microphone corresponding to the rear seat 104.

As described, by controlling the operation of the microphone not to be enabled while the operation of the speaker is disabled, it is possible to prevent the adaptive filter from being adapted in an improper state and prevent unpleasant sound and noise from being output.

The operation setting unit 502 may disable the speaker and microphone corresponding to each seat in which the occupant determining unit 501 determines that no occupant is present, and may transition the signal processing unit 210 to a power saving state or the like. By this, the reduction effect on the power consumption of the noise reduction device 100 can be expected, and it is possible to prevent the adaptive filter from being adapted in an improper state.

The auxiliary filter setting unit 503 sets setting values of the auxiliary filters of the signal processing units 210-1 to 210-4. Here, as described above, the auxiliary filters correspond to the first auxiliary filter 1111 of the first system, the first auxiliary filter 1112 of the second system, the second auxiliary filter 1121 of the first system, and the second auxiliary filter 1122 of the second system, which are illustrated in FIG. 3. The setting values of the auxiliary filters correspond to the transfer functions $H_{11}(z)$, $H_{12}(z)$, $H_{21}(z)$, and $H_{22}(z)$ of the auxiliary filters, as described above.

The auxiliary filter setting unit 503 according to the present embodiment has a function to change the setting values of the auxiliary filters used to generate the canceling sound by the signal processing unit 210 corresponding to a predetermined seat in accordance with the number of occupants in the seats other than the predetermined seat, affecting the noise in the predetermined seat.

For example, the auxiliary filter setting unit 503 performs a learning process described below while the speakers and microphones corresponding to the rear seats 103 and 104 that affect the noise in the driver seat 101, are enabled, and stores obtained setting values of the auxiliary filters (which will be hereinafter referred to as auxiliary filters A).

The auxiliary filter setting unit 503 performs the learning process while the speaker and microphone corresponding to either the rear seat 103 or the rear seat 104 (e.g., the rear seat 104) are disabled, and stores obtained setting values of the auxiliary filters (which will be hereinafter referred to as auxiliary filters B).

Further, as illustrated in FIG. 5A, when an occupant is present in each of the rear seats 103 and 104 that affect the noise in the driver seat 101 for example, the auxiliary filter setting unit 503 sets the previously stored setting values of the auxiliary filters A to the auxiliary filters of the signal processing unit 210-1.

With respect to the above, as illustrated in FIG. 5B, when no occupant is present in either the rear seat 103 or the rear seat 104 that affects the noise in the driver seat 101 for example, the auxiliary filter setting unit 503 sets the previously stored setting values of the auxiliary filters B to the auxiliary filters of the signal processing unit 210-1.

The driver seat 101 is an example of a predetermined seat. For example, when a predetermined seat is the rear seat 103 or the rear seat 104, seats affecting the noise in the predetermined seat are the driver seat 101 and the passenger seat. Also, for example, when a predetermined seat is the passenger seat 102, seats affecting the noise in the predetermined seat are the rear seats 103 and 104.

The storage unit 504 stores various information including the setting values of the auxiliary filters A and the setting values of the auxiliary filters B obtained by the learning process in advance, for example.

The learning controller 505 controls the learning process for obtaining the setting values of the auxiliary filters A and the setting values of the auxiliary filters B. The learning processing will be described later.

The setting values of the auxiliary filters A and the setting values of the auxiliary filters B may be obtained by performing the learning process in advance in another vehicle or the like having a configuration similar to the noise reduction system 1 for example, and the obtained setting values can be applied. Thus, the noise reduction device 100 may not necessarily include the learning controller 505.

<Process Flow>

Next, a process flow of the noise reduction method according to the present embodiment will be described.

(Operation Setting Process)

Figure 6:
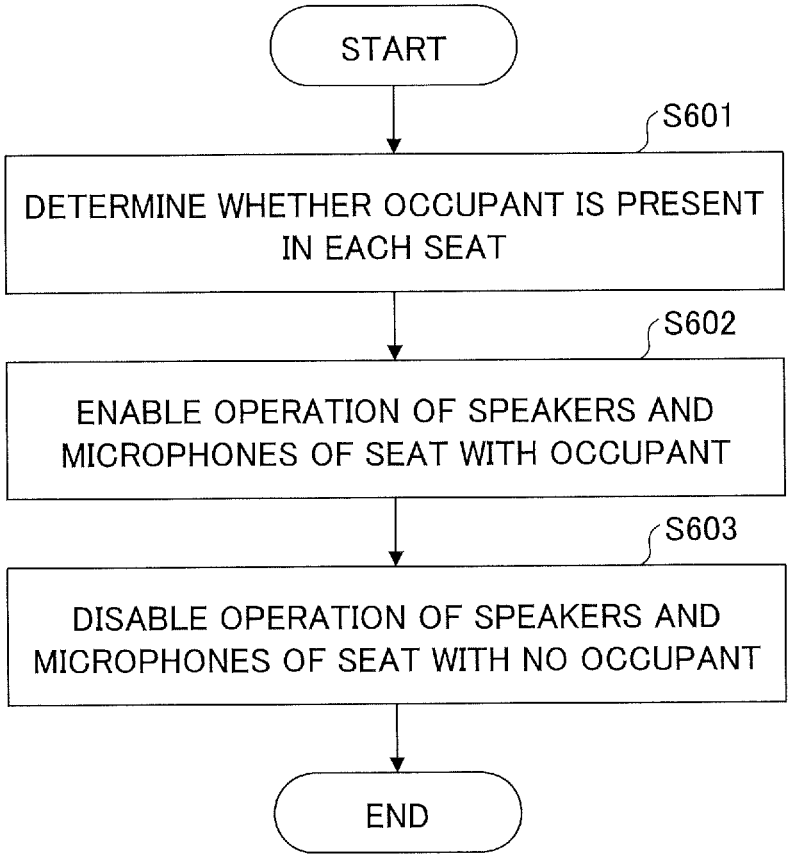
FIG. 6 is a flowchart illustrating an example of an operation setting process according to the embodiment.

FIG. 6 is a flowchart illustrating an example of an operation setting process according to the embodiment. This process illustrates an example of the operation setting process performed by the noise reduction system 1.

In step S601, the occupant determining unit 501 of the controller 220 determines whether an occupant is present in each seat in the vehicle 10. For example, the occupant determining unit 501 analyzes the image inside the vehicle 10 taken by the camera 105 to determine whether an occupant is present in each seat. Alternatively, the occupant determining unit 501 determines whether an occupant is present in each seat based on an output signal of the seat sensor equipped with the vehicle 10, information obtained from the on-board ECU, or the like.

In step S602, the operation setting unit 502 of the controller 220 enables the operations of the speakers 111L and 111R and the microphones 112L and 112R of a seat in which an occupant is present among the seats in the vehicle 10.

For example, when the signal processing unit 210 corresponding to a seat in which the occupant is present, mutes the speaker output and the microphone input, the operation setting unit 502 instructs the signal processing unit 210 to cancel the mute in the order of the speaker output and the microphone input. When the signal processing unit 210 corresponding to the seat in which the occupant is present, is set to the power saving state, the operation setting unit 502 instructs the signal processing unit 210 to return to a normal state.

When the operations of the speaker and the microphone of the seat in which the occupant is present, is already enabled, the operation setting unit 502 only needs to maintain a state in which the operations of the speaker and the microphone of the seat are enabled.

In step S603, the operation setting unit 502 of the controller 220 disables the operations of the speakers 111L and 111R and the microphones 112L and 112R of the empty seat among the seats in the vehicle 10.

For example, when the signal processing unit 210 corresponds to the empty seat does not mute the speaker output and the microphone input, the operation setting unit 502 instructs the signal processing unit 210 to mute the speaker output and the microphone input. Alternatively, the operation setting unit 502 may stop processing of the signal processing unit 210 corresponding to the empty seat and set the signal processing unit 210 to the power saving state.

The noise reduction system 1, for example, repeatedly performs the above-described process to stop the noise reduction process and the output of contents, such as music and voice, in each empty seat among the seats in the vehicle 10.

(Auxiliary Filter Setting Process in the Driver Seat)

Figure 7:
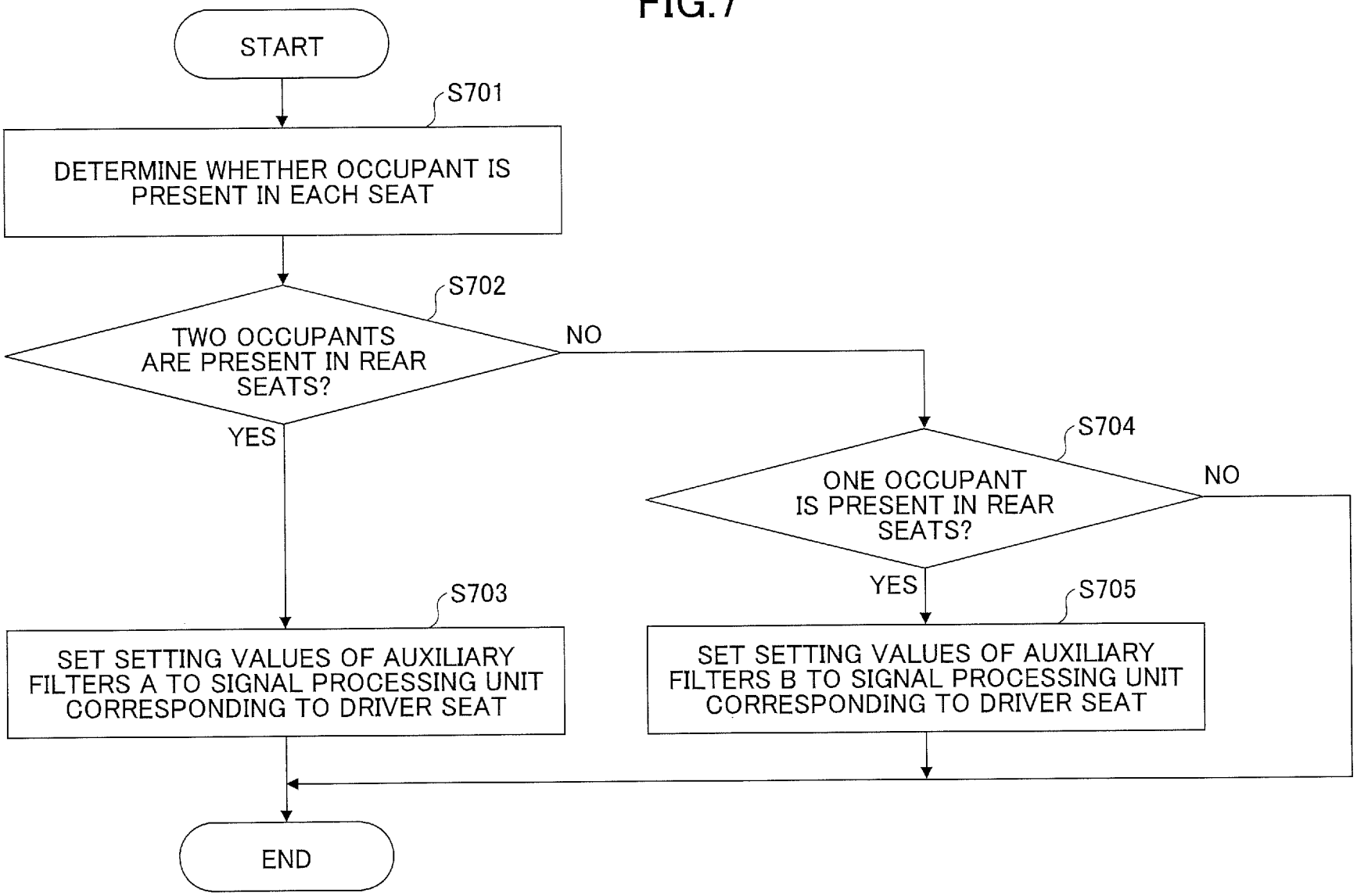
FIG. 7 is a flowchart illustrating an example of an auxiliary filter setting process in a driver seat according to the embodiment.

FIG. 7 is a flowchart illustrating an example of an auxiliary filter setting process in the driver seat according to the embodiment. This process indicates an example of the auxiliary filter setting process performed by the controller 220 of the noise reduction device 100 on the signal processing unit 210-1 corresponding to the driver seat 101, for example. The process is performed in parallel with the operation setting process illustrated in FIG. 6 or before the operation setting process illustrated in FIG. 6, for example.

In step S701, the occupant determining unit 501 of the controller 220 determines whether an occupant is present in each seat in the vehicle 10. Here, this process may be common to the process in step S601 of FIG. 6.

In step S702, the auxiliary filter setting unit 503 of the controller 220 branches the process according to whether two occupants are present in the rear seats 103 and 104 (whether an occupant is present in each of the rear seats 103 and 104) that affect the noise in the driver seat 101.

When two occupants are present in the rear seats 103 and 104, the auxiliary filter setting unit 503 moves the process to step S703. When two occupants are not present in the rear seats 103 and 104, the auxiliary filter setting unit 503 moves the process to step S704.

When the process proceeds to step S703, the auxiliary filter setting unit 503 sets the previously stored setting values of the auxiliary filters A to the auxiliary filters used by the signal processing unit 210-1 corresponding to the driver seat 101 for generating the canceling sound. For example, the auxiliary filter setting unit 503 sets the transfer functions $H_{11}(z)$, $H_{12}(z)$, $H_{21}(z)$, and $H_{22}(z)$ of the auxiliary filters A, which are learned while the speakers and the microphones of the rear seats 103 and 104 are enabled, to the auxiliary filters of the signal processing unit 210-1. When the setting values of the auxiliary filters A are already set to the signal processing unit 210-1, the auxiliary filter setting unit 503 only needs to maintain the current setting values.

When the process proceeds to step S704, the auxiliary filter setting unit 503 branches the process according to whether one occupant or no occupant is present in the rear seats 103 and 104.

When one occupant is present in the rear seats 103 and 104, the auxiliary filter setting unit 503 moves the process to step S705. When no occupant is present in the rear seats 103 and 104, the auxiliary filter setting unit 503 terminates the process illustrated in FIG. 7.

When the process proceeds to step S705, the auxiliary filter setting unit 503 sets the previously stored setting values of the auxiliary filters B to the auxiliary filters used by the signal processing unit 210-1 corresponding to the driver seat 101 for generating the canceling sound. For example, the auxiliary filter setting unit 503 sets the transfer functions $H_{11}(z)$, $H_{12}(z)$, $H_{21}(z)$, and $H_{22}(z)$ of the auxiliary filters B, which are learned while the speakers and the microphone of either the rear seat 103 or the rear seat 104 are disabled, to the auxiliary filters of the signal processing unit 210-1. When the setting values of the auxiliary filters B are already set to the signal processing unit 210-1, the auxiliary filter setting unit 503 only needs to maintain the current setting values.

By the above-described process, for example, when no occupant is present in the rear seat 104 of the vehicle 10, the operations of the speakers and microphones in the rear seat 104 are disabled, and the canceling sound for the driver seat 101 is generated using the auxiliary filters learned while one occupant is present in the rear seat.

(Auxiliary Filter Setting Process in a Predetermined Seat)

The auxiliary filter setting process illustrated in FIG. 7 can also be performed for each seat (or a predetermined seat) in the vehicle 10.

Figure 8:
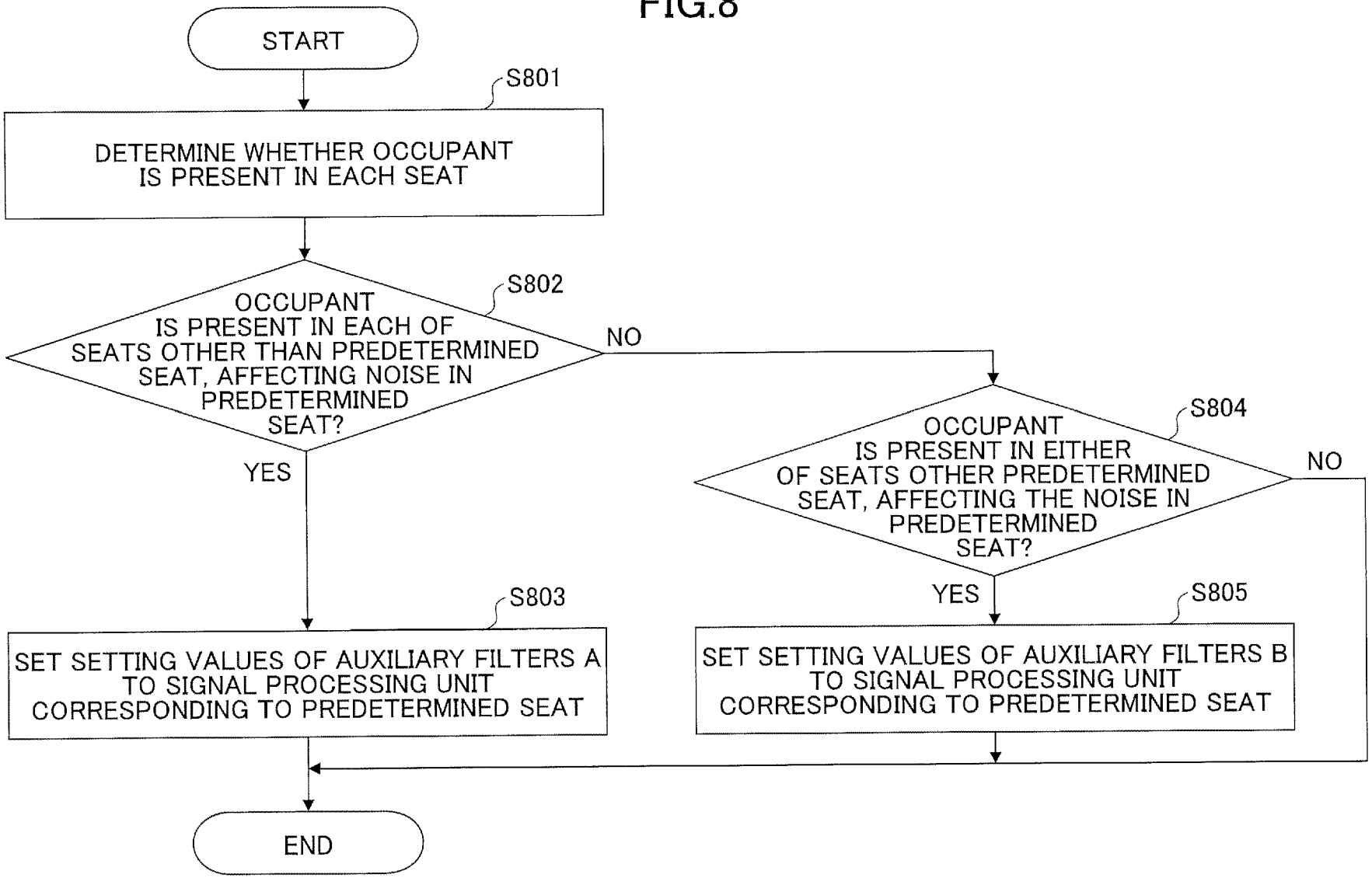
FIG. 8 is a flowchart illustrating an example of an auxiliary filter setting process in a predetermined seat according to the embodiment.

FIG. 8 is a flowchart illustrating an example of the auxiliary filter setting process in the driver seat according to the embodiment. This process illustrates a flow chart when the auxiliary filter setting process illustrated in FIG. 7 is applied to a predetermined seat in the vehicle 10. Since the basic processing content is similar to the auxiliary filter setting process illustrated in FIG. 7, a detailed description of the similar processing content is omitted.

In step S801, the occupant determining unit 501 of the controller 220 determines whether an occupant is present in each seat in the vehicle 10. This process is similar to the process in step S601 of FIG. 6 and the process in step S701 of FIG. 7.

In step S802, the auxiliary filter setting unit 503 of the controller 220 branches the process according to whether an occupant is present in each of the seats other than the predetermined seat, affecting the noise in the predetermined seat.

For example, when a predetermined seat is the passenger seat 102 (or the driver seat 101), seats other than the predetermined seat, affecting the noise in the predetermined seat, are the rear seats 103 and 104. When a predetermined seat is the rear seat 103 or the rear seat 104, seats other than the predetermined seat, affecting the noise in the predetermined seat, are the driver seat 101 and the passenger seat 102.

When an occupant is present in each of the seats other than the predetermined seat, affecting the noise in the predetermined seat, the auxiliary filter setting unit 503 moves the process to step S803. When occupants are not present in both of the seats other than the predetermined seat, affecting the noise in the predetermined seat (when no occupant is present in either or both of the seats other than the predetermined seat), the auxiliary filter setting unit 503 moves the process to step S804.

When the process proceeds to step S803, the auxiliary filter setting unit 503 sets the previously stored setting values of the auxiliary filters A to the auxiliary filters used by the signal processing unit 210 corresponding to the predetermined seat for generating the canceling sound.

For example, when the predetermined seat is the rear seat 103, the auxiliary filter setting unit 503 sets the setting values of the auxiliary filters A, which are learned while the speakers and the microphones corresponding to the driver seat 101 and the passenger seat 102 are enabled, to the signal processing unit 210-3. Similarly, when the predetermined seat is the rear seat 104, the auxiliary filter setting unit 503 sets the setting values of the auxiliary filters A, which are learned while the speakers and the microphones corresponding to the driver seat 101 and the passenger seat 102 are enabled, to the signal processing unit 210-4.

When the predetermined seat is the passenger seat 102, the auxiliary filter setting unit 503 sets the setting values of the auxiliary filters A, which are learned while the speakers and the microphones corresponding to the rear seats 103 and 104 are enabled, to the signal processing unit 210-2. The process performed when the predetermined seat is the driver seat 101 is similar to the process in step S703 of FIG. 7.

When the process proceeds to step S804, the auxiliary filter setting unit 503 branches the process according to whether an occupant is present in either of the seats other than the predetermined seat, affecting the noise in the predetermined seat.

When an occupant is present in either of the seats other than the predetermined seat, affecting the noise in the predetermined seat, the auxiliary filter setting unit 503 moves the process to step S805. When no occupant is present in the seats other than the predetermined seat, affecting the noise in the predetermined seat, the auxiliary filter setting unit 503 terminates the process of FIG. 8.

When the process proceeds to step S805, the auxiliary filter setting unit 503 sets the previously stored setting values of the auxiliary filters B to the auxiliary filters used by the signal processing unit 210 corresponding to the predetermined seat for generating the canceling sound.

For example, when the predetermined seat is the rear seat 103, the auxiliary filter setting unit 503 sets the setting values of the auxiliary filters B, which are learned while the speakers and the microphones corresponding to either the driver seat 101 or the passenger seat 102 are disabled, to the signal processing unit 210-3. Similarly, when the predetermined seat is the rear seat 104, the auxiliary filter setting unit 503 sets the setting values of the auxiliary filters B, which are learned while the speakers and the microphones corresponding to either the driver seat 101 or the passenger seat 102 are disabled, to the signal processing unit 210-4.

When the predetermined seat is the passenger seat 102, the auxiliary filter setting unit 503 sets the setting values of the auxiliary filters B, which are learned while the speakers and the microphones corresponding to either the rear seat 103 or the rear seat 104 are disabled, to the signal processing unit 210-2. The process performed when the predetermined seat is the driver seat 101 is similar to the process in step S705 of FIG. 7.

The above-described process enables the controller 220 to appropriately change the setting values of the auxiliary filters used by the signal processing unit 210 corresponding to a given seat to generate the canceling sound in accordance with the number of occupants in the seats other than the given seat, affecting the noise in the given seat, for each of the seats in the vehicle 10.

<Effect>

Figure 9:
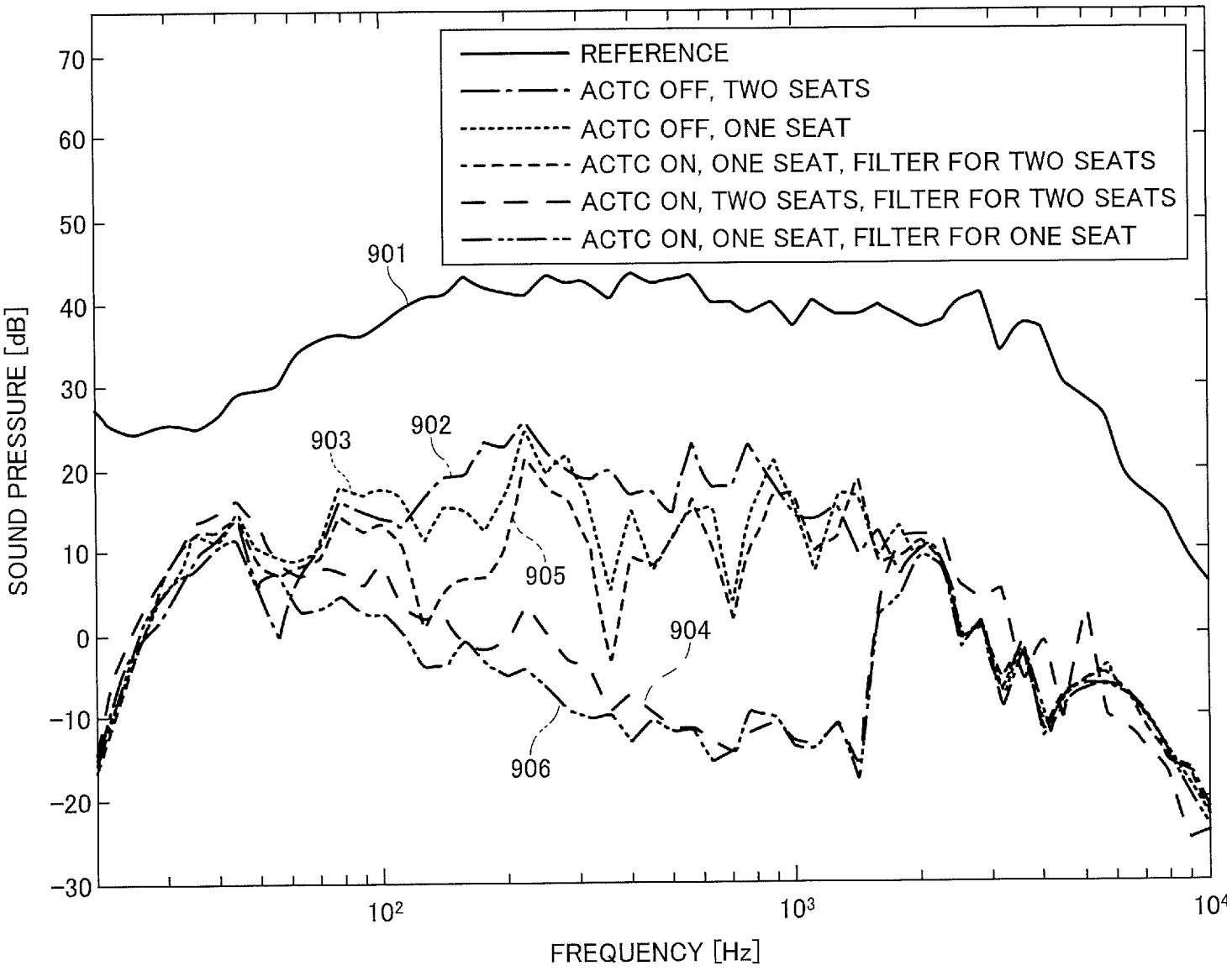
FIG. 9 is a drawing for describing an effect of a noise reduction method according to the embodiment.

FIG. 9 is a drawing for describing an effect of a noise reduction method according to the embodiment. FIG. 9 is a graph indicating the noise reduction effect of the noise reduction system 1. The horizontal axis indicates the frequency and the vertical axis indicates the sound pressure of the noise.

In FIG. 9, a line 901 indicates the sound pressure of a reference signal as the noise source. A line 902 indicates the sound pressure of the noise measured in the driver seat 101 while the speakers of the rear seats 103 and 104 are enabled and the noise reduction process is disabled.

A line 903 of FIG. 9 indicates the sound pressure of the noise measured in the driver seat 101 while the speakers of the rear seat 103 are enabled, the speakers of the rear seat 104 are disabled, and the noise reduction process is disabled. As illustrated, even when the noise reduction process performed by the noise reduction device 100 is disabled, when the speakers of the rear seat 104 are disabled, the noise sources affecting the noise in the driver seat 101 are reduced, so that the sound pressure of the noise in the driver seat 101 can be reduced.

A line 904 of FIG. 9 indicates the sound pressure of the noise measured in the driver seat 101 while the speakers of the rear seats 103 and 104 are enabled, and the noise reduction process to which the auxiliary filters A are applied, is enabled. As illustrated, the noise reduction process performed by the noise reduction device 100 can significantly reduce the sound pressure of the noise in the driver seat 101.

With respect to the above, a line 905 of FIG. 9 indicates the sound pressure of the noise measured in the driver seat 101 while the speakers of the rear seat 103 are enabled, the speakers of the rear seat 104 are disabled, and the noise reduction process, to which the auxiliary filters A (i.e., filters for two seats) are applied, is enabled. As illustrated, it is found that when the noise reduction process to which the auxiliary filters A are applied, is performed, if the speakers of either the rear seat 103 or the rear seat 104, which is the noise source, are disabled, the noise reduction effect in the driver seat 101 is deteriorated. This may be because, for example, disabling the outputs of the speakers in either the rear seat 103 or the rear seat 104 changes the characteristic of the primary path included in the auxiliary filter.

Thus, the noise reduction device 100 according to the present embodiment applies the auxiliary filters B (i.e., filters for one seat) when the outputs of the speakers in either the rear seat 103 or the rear seat 104 are disabled. A line 906 of FIG. 9 indicates the sound pressure of the noise measured in the driver seat 101 while the speakers of the rear seat 103 are enabled, the speakers of the rear seat 104 are disabled, and the noise reduction process, to which the auxiliary filters B are applied, is enabled. As illustrated, it has been confirmed that when the outputs of the speakers in either the rear seat 103 or the rear seat 104 are disabled, the noise reduction effect in the driver seat 101 can be significantly improved by performing the noise reduction process to which the auxiliary filters B are applied.

This can also save power consumption for the noise reduction process corresponding to an empty seat.

<Configuration Example for Outputting the Content Signal>

Figure 10:
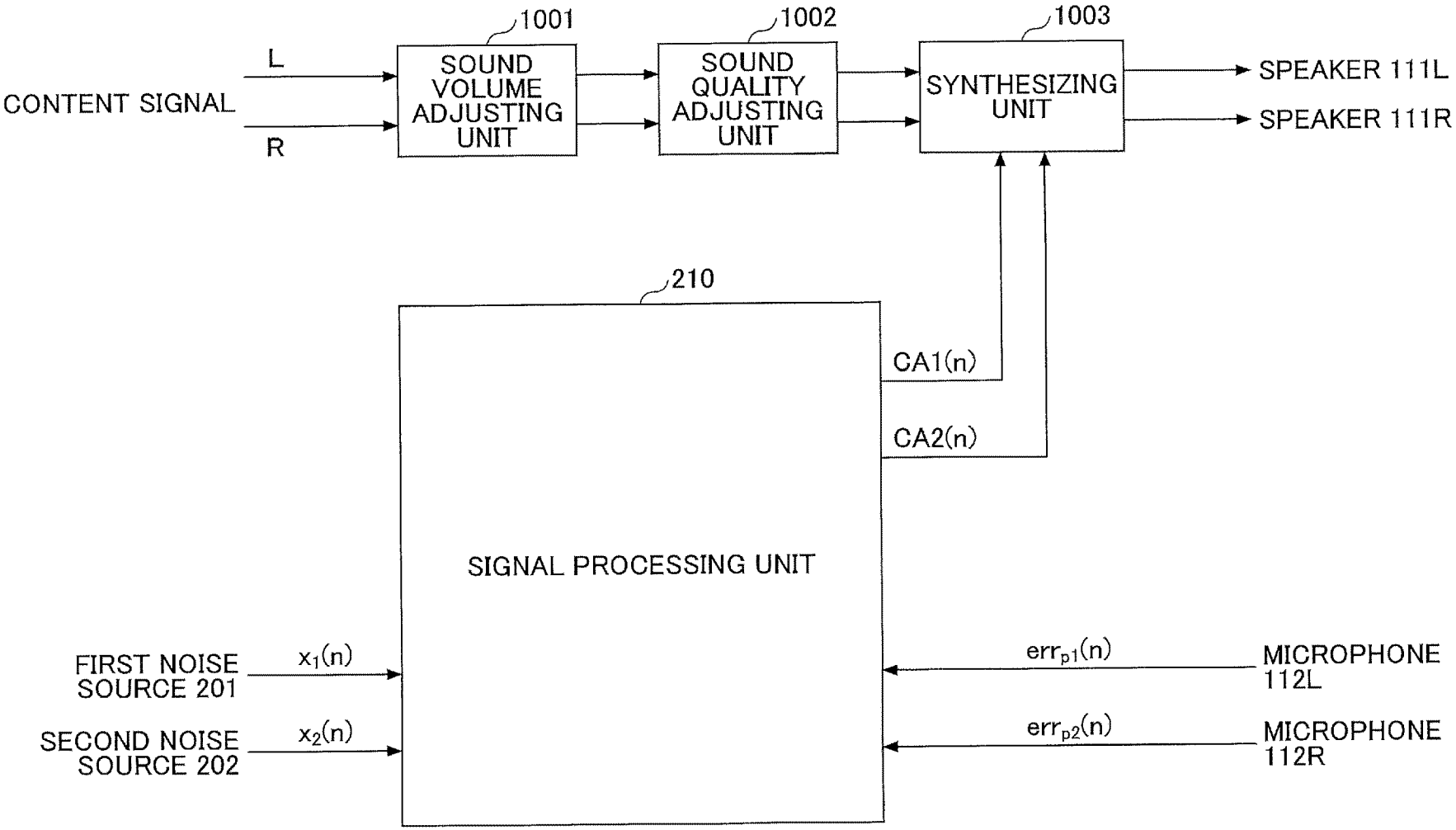
FIG. 10 is a drawing illustrating a configuration example for outputting a content signal according to the embodiment.

FIG. 10 is a drawing illustrating a configuration example for outputting a content signal according to the embodiment. For example, in the noise reduction device 100 illustrated in FIG. 2, when the contents, such as music, voice, and ambient sound, are output from the speakers 111L and 111R, as illustrated in FIG. 10, a sound volume adjusting unit 1001, a sound quality adjusting unit 1002, and a synthesizing unit 1003 may be added to each signal processing unit 210.

The sound volume adjusting unit 1001 is implemented by, for example, a DSP implementing the signal processing unit 210, or a sound volume adjusting circuit, and changes the volume of the content signals (L and R), such as music, output from the speakers 111L and 111R in accordance with an operation by a user, for example.

The sound quality adjusting unit 1002 is implemented by, for example, a DSP implementing the signal processing unit 210, or a sound quality adjusting circuit, and changes the frequency characteristic, delay time, gain, and the like of the content signals (L and R) in accordance with the operation of the user, for example.

The synthesizing unit 1003 is implemented by, for example, a DSP implementing the signal processing unit 210, or a speech synthesizing circuit, synthesizes a content signal (L) and a cancellation signal CA1(*n*), and outputs a synthesized signal to the speaker 111L. The synthesizing unit 1003 synthesizes a content signal (R) and the cancellation signal CA2(*n*) and outputs a synthesized signal to the speaker 111R.

With the above-described configuration, for example, the signal processing unit 210-1 corresponding to the driver seat 101 outputs the content to the driver seat 101 at a volume and quality desired by the user and can reduce the noise from the rear seats 103 and 104.

<Learning Process>

Next, a learning process for obtaining the setting values that are set to the auxiliary filters of the signal processing unit 210, that is, the transfer functions $H_{11}(z)$, $H_{12}(z)$, $H_{21}(z)$, and $H_{22}(z)$, will be described.

The learning process is performed under a standard acoustic environment that is a standard acoustic environment to which the noise reduction system 1 is applied (e.g., in the vehicle 10). The learning process includes a first step learning process and a second step learning process.

Figure 11:
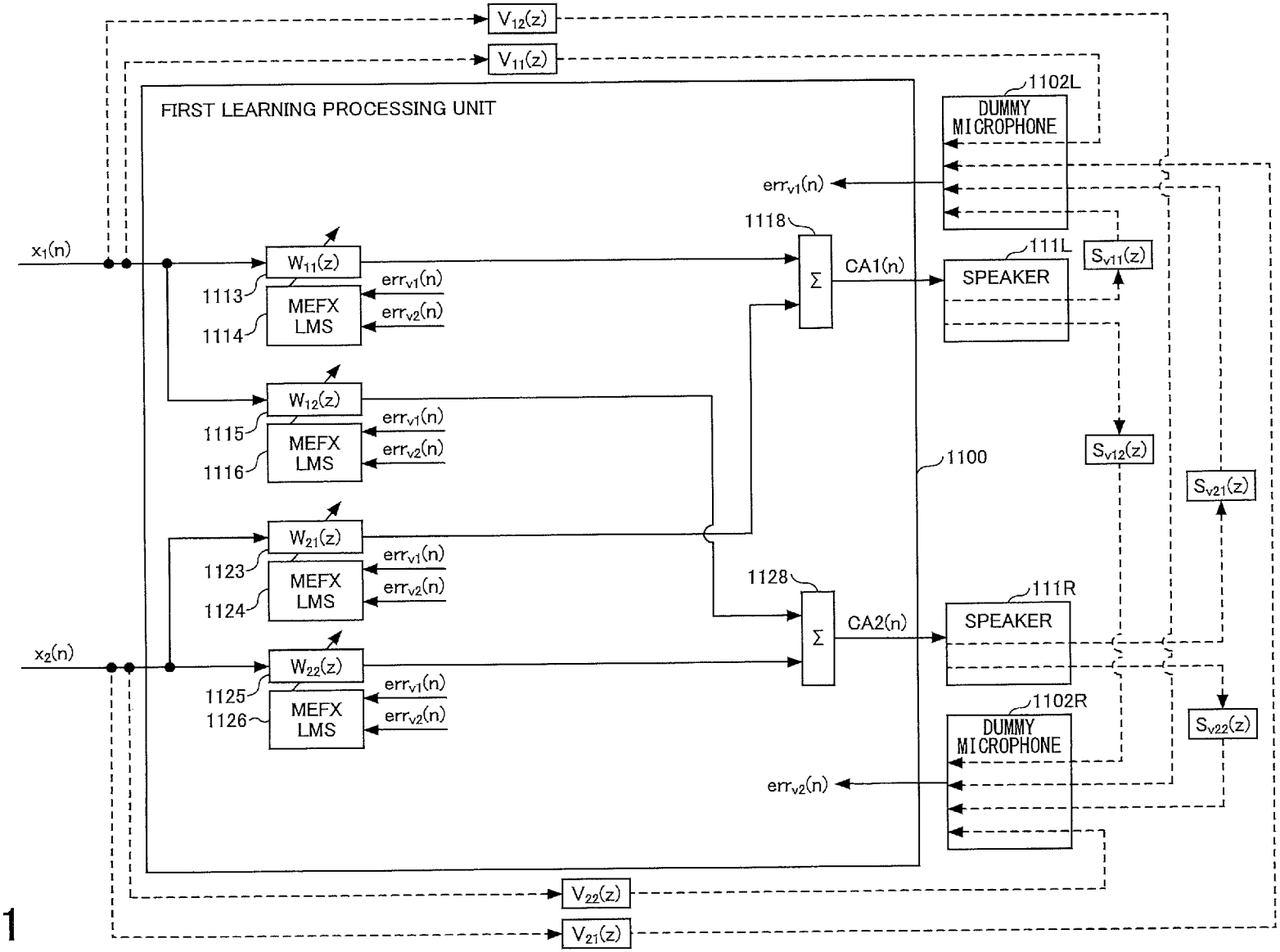
FIG. 11 is a drawing illustrating a configuration example of a first learning processing unit according to the embodiment.

FIG. 11 is a drawing illustrating a configuration example of a first learning processing unit according to the embodiment. The first step learning process is performed by a configuration in which the signal processing unit 210 of the noise reduction device 100 is replaced with the first learning processing unit 1100 as illustrated in FIG. 11. Here, as illustrated in FIG. 11, the first learning processing unit 1100 has a configuration in which the first auxiliary filter 1111 of the first system, the first auxiliary filter 1112 of the second system, the second auxiliary filter 1121 of the first system, the second auxiliary filter 1122 of the second system, the error correction adding unit 1117 of the first system, and the error correction adding unit 1127 of the second system are removed from the signal processing unit 210 illustrated in FIG. 3.

The first step learning process is performed in a state in which a dummy microphone 1102L disposed at the first cancel point and a dummy microphone 1102R disposed at the second cancel point are coupled to the first learning processing unit 1100.

The first learning processing unit 1100 is configured to use a sound signal $err_{v1}(n)$ output from the dummy microphone 1102L, and a sound signal $err_{v2}(n)$ output from the dummy microphone 1102R as multiple errors of the first adaptive algorithm execution unit 1114 of the first system, the first adaptive algorithm execution unit 1116 of the second system, the second adaptive algorithm execution unit 1124 of the first system, and the second adaptive algorithm execution unit 1126 of the second system.

In the first learning processing unit 1100, the first adaptive algorithm execution unit 1114 of the first system updates the transfer function $W_{11}(z)$ of the first variable filter 1113 of the first system by using the MEFX LMS algorithm, so that $err_{v1}(n)$ and $err_{v2}(n)$ that are input as multiple errors become zero. The first adaptive algorithm execution unit 1116 of the second system updates the transfer function $W_{12}(z)$ of the first variable filter 1115 of the second system by using the MEFX LMS algorithm, so that $err_{v1}(n)$ and $err_{v2}(n)$ that are input as multiple errors are zero. Further, the second adaptive algorithm execution unit 1124 of the first system updates the transfer function $W_{21}(z)$ of the second variable filter 1123 of the first system by using the MEFX LMS algorithm, so that $err_{v1}(n)$ and $err_{v2}(n)$ that are input as multiple errors are zero. Still further, the second adaptive algorithm execution unit 1126 of the second system updates the transfer function $W_{22}(z)$ of the second variable filter 1125 of the second system by using the MEFX LMS algorithm, so that $err_{v1}(n)$ and the $err_{v2}(n)$ that are input as multiple errors are zero.

Dummy heads equipped with the dummy microphones 1102L and 1102R are used to dispose the dummy microphone 1102L at the first cancel point and dispose the dummy microphone 1102R at the second cancel point, for example. The first learning processing unit 1100 is implemented by, for example, the learning controller 505 of the controller 220 rewriting a program of the DSP constituting the signal processing unit 210.

In the first step learning process using the first learning processing unit 1100, the noise signal $x_1(n)$ and the noise signal $x_2(n)$ are input to the first learning processing unit 1100. In this state, convergence of the transfer function $W_{11}(z)$ of the first variable filter 1113 of the first system, the transfer function $W_{12}(z)$ of the first variable filter 1115 of the second system, the transfer function $W_{21}(z)$ of the second variable filter 1123 of the first system, and the transfer function $W_{22}(z)$ of the second variable filter 1125 of the second system is awaited. When each of the transfer functions has converged, each of the transfer functions $W_{11}(z)$, $W_{12}(z)$, $W_{21}(z)$, and $W_{22}(z)$ is obtained.

Here, as illustrated in FIG. 11, a transfer function of the noise signal $x_1(n)$ to the output of the dummy microphone 1102 L is $V_{11}(z)$, and a transfer function of the noise signal $x_1(n)$ to the output of the dummy microphone 1102R is $V_{12}(z)$. A transfer function of the noise signal $x_2(n)$ to the output of the dummy microphone 1102L is $V_{21}(z)$, and a transfer function of the noise signal $x_2(n)$ to the output of the dummy microphone 1102R is $V_{22}(z)$. Furthermore, a transfer function of the cancellation signal CA1(*n*) to the output of the dummy microphone 1102L is $S_{v11}(z)$, and a transfer function of the cancellation signal CA1(*n*) to the output of the dummy microphone 1102R is $S_{v12}(z)$.

A transfer function of the cancellation signal CA2(*n*) to the output of the dummy microphone 1102L is $S_{v21}(z)$, and a transfer function of the cancellation signal CA2(*n*) to the output of the dummy microphone 1102R is $S_{v22}(z)$. If the Z-conversion of $x_i(n)$ is $x_i(z)$ and the Z-conversion of $err_{vi}(n)$ is $err_{vi}(z)$, then $err_{v1}(z)$ output by the dummy microphone 1102L is as follows.

$$\begin{aligned} err_{v1}(z) = {} & x_1(z)V_{11}(z) + \{x_1(z)W_{11}(z) + x_2(z)W_{21}(z)\}S_{v11}(z) + \\ & \{x_1(z)W_{12}(z) + x_2(z)W_{22}(z)\}S_{v21}(z) + x_2(z)V_{21}(x) = \\ & x_1(z)\{V_{11}(z) + W_{11}(z)S_{v11}(z) + W_{12}(z)S_{v21}(z)\} + \\ & x_2(z)\{V_{21}(x) + W_{21}(x)S_{v11}(z) + W_{22}(z)S_{v21}(z)\} \end{aligned} \quad \text{[Eq. 1]}$$

Similarly, $err_{v2}(z)$ output by the dummy microphone 1102R is as follows.

$$\begin{aligned} err_{v2}(z) = {} & x_1(z)[V_{12}(z) + W_{11}(z)S_{v12}(z) + W_{12}(z)S_{v22}(z)] + \\ & x_2(z)[V_{22}(x) + W_{21}(x)S_{V12}(z) + W_{22}(z)S_{V22}(z)] \end{aligned} \quad \text{[Eq. 2]}$$

Here, as $x_1(z) \neq 0$ and $x_2(z) \neq 0$, the following equations can be obtained when $err_{v1}(z)$=zero and $err_{v2}(z)$=zero.

$$\{V_{11}(z)+W_{11}(z)S_{v11}(z)+W_{12}(z)S_{v21}(z)\}=0$$

$$\{V_{21}(x)+W_{21}(x)S_{v11}(z)+W_{22}(z)S_{v21}(z)\}=0$$

$$\{V_{12}(z)+W_{11}(z)S_{v12}(z)+W_{12}(z)S_{v22}(z)\}=0$$

$$\{V_{11}(x)+W_{21}(x)S_{v12}(z)+W_{22}(z)S_{v22}(z)\}=0 \quad \text{[Eq. 3]}$$

By solving the simultaneous equations with respect to $W_{11}$, $W_{12}$, $W_{21}$, and $W_{22}$, the following equations are obtained.

$$W_{11}=\{V_{12}(z)S_{v21}(z)-V_{11}(z)S_{v22}(z)\}/\{S_{v11}(z)S_{v22}(z)-S_{v12}(z)S_{v21}(z)\}$$

$$W_{12}=\{V_{11}(z)S_{v12}(z)-V_{12}(z)S_{v11}(z)\}/\{S_{v11}(z)S_{v22}(z)-S_{v12}(z)S_{v21}(z)\}$$

$$W_{21}=\{V_{22}(z)S_{v21}(z)-V_{21}(z)S_{v22}(z)\}/\{S_{v11}(z)S_{v22}(z)-S_{v12}(z)S_{v21}(z)\}$$

$$W_{22}=\{V_{21}(z)S_{v12}(z)-V_{22}(z)S_{v11}(z)\}/\{S_{v11}(z)S_{v22}(z)-S_{v12}(z)S_{v21}(z)\} \quad \text{[Eq. 4]}$$

In the first learning processing unit 1100, the transfer functions $W_{11}(z)$, $W_{12}(z)$, $W_{21}(z)$, and $W_{22}(z)$ converge to these values.

The values of the converged transfer functions $W_{11}$, $W_{12}$, $W_{21}$, and $W_{22}$ cancel the noise generated by the first noise source 201 and the noise generated by the second noise source 202 at the first cancel point and the second cancel point.

When the transfer functions $W_{11}(z)$, $W_{12}(z)$, $W_{21}(z)$, and $W_{22}(z)$ that have converged in the first step learning process using the first learning processing unit 1100 are obtained, the first step learning process is terminated, and the second step learning process is performed.

Figure 12:
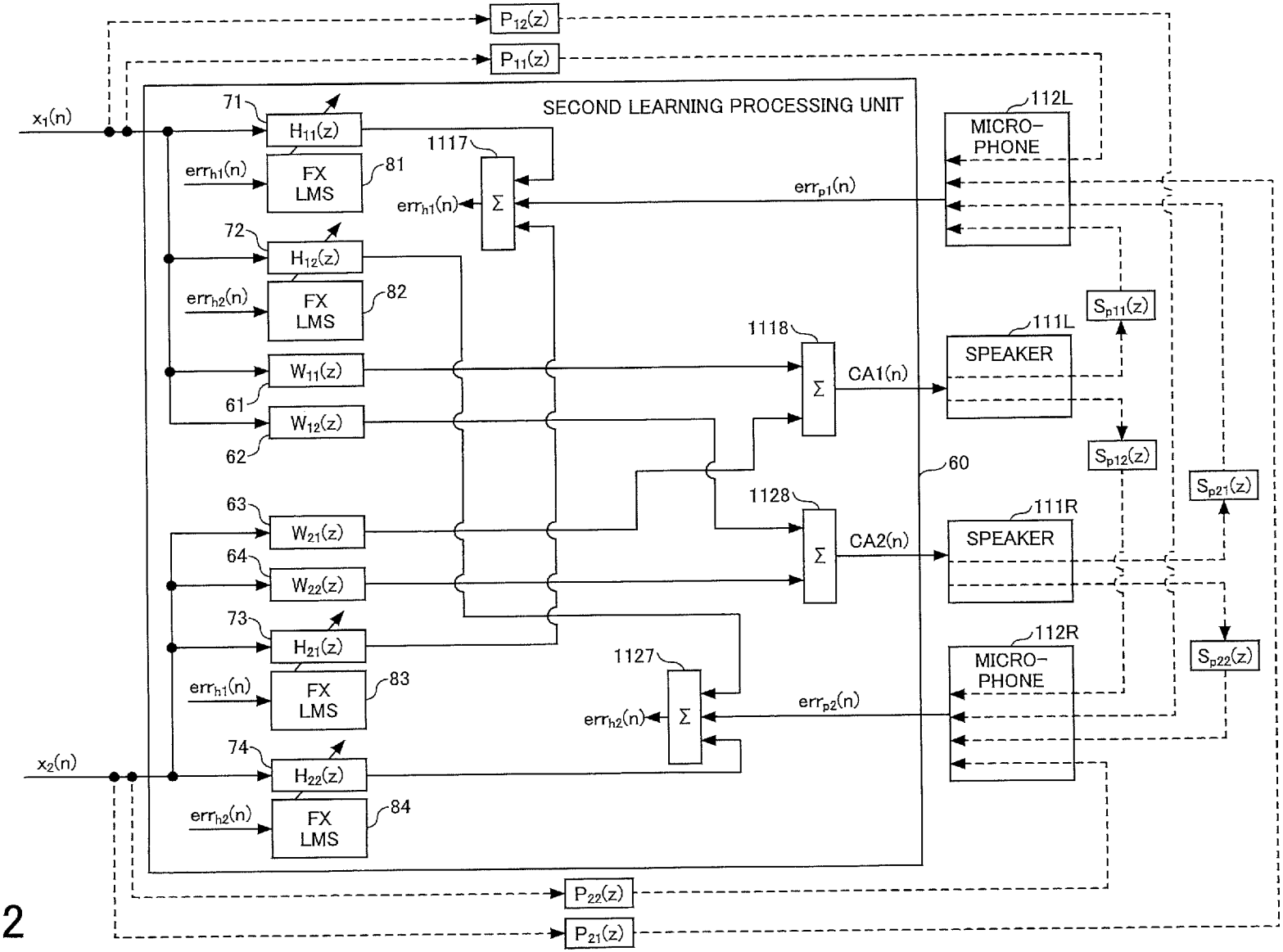
FIG. 12 is a drawing illustrating a configuration example of a second learning processing unit according to the embodiment.

FIG. 12 is a drawing illustrating a configuration example of a second learning processing unit according to the embodiment. As illustrated in FIG. 12, the second step learning process is performed in a configuration in which the signal processing unit 210 of the noise reduction system 1 is replaced with the second learning processing unit 60. Here, as illustrated in FIG. 12, the second learning processing unit 60 has a configuration in which the first adaptive algorithm execution unit 1114 of the first system, the first adaptive algorithm execution unit 1116 of the second system, the second adaptive algorithm execution unit 1124 of the first system, and the second adaptive algorithm execution unit 1126 of the second system are removed from the signal processing unit 210 illustrated in FIG. 3.

As illustrated in FIG. 12, the first variable filter 1113 of the first system is replaced with a first fixed filter 61 of the first system in which the transfer function is fixed to the transfer function $W_{11}(z)$ obtained in the first step learning process. The first variable filter 1115 of the second system is replaced with a first fixed filter of the second system in which the transfer function is fixed to the transfer function $W_{12}(z)$ obtained in the first step learning process. Further, the second variable filter 1123 of the first system is replaced with a second fixed filter of the first system in which the transfer function is fixed to the transfer function $W_{21}(z)$ obtained in the first step learning process. Still further, the second variable filter 1125 of the second system is replaced with a second fixed filter of the second system in which the transfer function is fixed to the transfer function $W_{22}(z)$ obtained in the first step learning process.

In the second learning processing unit 60, as illustrated in FIG. 12, the first auxiliary filter 1111 of the first system in the signal processing unit 210 illustrated in FIG. 3 is replaced with a first variable auxiliary filter 71 of the first system. Further, a first learning adaptive algorithm execution unit 81 of the first system that updates the transfer function $H_{11}(z)$ of the first variable auxiliary filter 71 of the first system by using an FXLMS algorithm, is provided. In the second learning processing unit 60, the first auxiliary filter 1112 of the second system is replaced with a first variable auxiliary filter 72 of the second system. Further, a first learning adaptive algorithm execution unit 82 of the second system that updates the transfer function $H_{12}(z)$ of the first variable auxiliary filter 72 of the second system by using the FXLMS algorithm, is provided.

In the second learning processing unit 60, the second auxiliary filter 1121 of the first system is replaced with a second variable auxiliary filter 73 of the first system. Further, a second learning adaptive algorithm execution unit 83 of the first system that updates the transfer function $H_{21}(z)$ of the second variable auxiliary filter 73 of the first system by using the FXLMS algorithm, is provided. In the second learning processing unit 60, the second auxiliary filter 1122 of the second system is replaced with a second variable auxiliary filter 74 of the second system. Further, the second learning adaptive algorithm execution unit 84 of the second system that updates the transfer function $H_{22}(z)$ of the second variable auxiliary filter 74 of the second system by using the FXLMS algorithm, is provided.

In the second learning processing unit 60, the error signal $err_{h1}(n)$ output by the error correction adding unit 1117 of the first system is output as an error to the first learning adaptive algorithm execution unit 81 of the first system and the second learning adaptive algorithm execution unit 83 of the first system. The error signal $err_{h2}(n)$ output by the error correction adding unit 1127 of the second system is output as an error to the first learning adaptive algorithm execution unit of the second system and the second learning adaptive algorithm execution unit 84 of the second system.

The first learning adaptive algorithm execution unit 81 of the first system updates the transfer function $H_{11}(z)$ of the first variable auxiliary filter 71 of the first system by using the FXLMS algorithm, so that the error signal $err_{h1}(n)$ input as an error becomes zero. The first learning adaptive algorithm execution unit 82 of the second system updates the transfer function $H_{12}(z)$ of the first variable auxiliary filter 72 of the second system by using the FXLMS algorithm, so that the error signal $err_{h2}(n)$ input as an error becomes zero.

The second learning adaptive algorithm execution unit 83 of the first system updates the transfer function $H_{21}(z)$ of the second variable auxiliary filter 73 of the first system by using the FXLMS algorithm, so that the error signal $err_{h1}(n)$ input as an error becomes zero. Further, the second learning adaptive algorithm execution unit 84 of the second system updates the transfer function $H_{22}(z)$ of the second variable auxiliary filter 74 of the second system by using the FXLMS algorithm, so that the error signal $err_{h2}(n)$ input as an error becomes zero. The second learning processing unit 60 is achieved by, for example, the learning controller 505 of the controller 220 rewriting a program of the DSP constituting the signal processing unit 210.

In the second step learning process using the second learning processing unit 60, the noise signal $x_1(n)$ and the noise signal $x_2(n)$ are input to the second learning processing unit 60. In this state, convergence of the transfer function $H_{11}(z)$ of the first variable auxiliary filter 71 of the first system, the transfer function $H_{12}(z)$ of the first variable auxiliary filter 72 of the second system, the transfer function $H_{21}(z)$ of the second variable auxiliary filter 73 of the first system, and the transfer function $H_{22}(z)$ of the second variable auxiliary filter 73 of the second system is awaited. If each of the transfer functions converges, each of the transfer functions $H_{11}(z)$, $H_{12}(z)$, $H_{21}(z)$, and $H_{22}(z)$ is obtained.

Here, as illustrated in FIG. 12, a transfer function of the noise signal $x_1(n)$ to the output of the microphone 112L is $P_{11}(z)$, and a transfer function of the noise signal $x_1(n)$ to the output of the microphone 112R is $P_{12}(z)$. A transfer function of the noise signal $x_2(n)$ to the output of the microphone 112L is $P_{21}(z)$, and a transfer function of the noise signal $x_2(n)$ to the output of the microphone 112R is $P_{22}(z)$. Furthermore, a transfer function of the cancellation signal CA1(*n*) to the output of the microphone 112L is $S_{P11}(z)$, and a transfer function of the cancellation signal CA1(*n*) to the output of the microphone 112R is $S_{P12}(z)$.

A transfer function of the cancellation signal CA2(*n*) to the output of the microphone 112L is $S_{P21}(z)$, and a transfer function of the cancellation signal CA2(*n*) to the output of the microphone 112R is $S_{P22}(z)$. If the Z conversion of $err_{pi}(n)$ is $err_{pi}(z)$ and the Z conversion of $err_{hi}(n)$ is $err_{hi}(z)$, $err_{p1}(z)$ output by the microphone 112L is as follows.

$$\begin{aligned} err_{P1}(z) &= x_1(z)P_{11}(z) + \{x_1(z)W_{11}(z) + x_2W_{21}(x)\}S_{p11}(z) + \\ &\{x_1(z)W_{12}(z) + x_2(z)W_{22}(z)\}S_{p21}(z) + x_2(z)P_{21}(x) = \\ &x_1(z)\{P_{11}(z) + W_{11}(z)S_{p11}(z) + W_{12}(z)S_{p21}(z)\} + \\ &x_2(z)\{P_{21}(x) + W_{21}(x)S_{p11}(z) + W_{22}(z)S_{p21}(z)\} \end{aligned} \quad \text{[Eq. 5]}$$

Similarly, $err_{p2}(z)$ output by the microphone 112R is as follows.

$$\begin{aligned} err_{P2}(z) &= x_1(z)[P_{12}(z) + W_{11}(z)S_{p12}(z) + W_{12}(z)S_{p22}(z)] + \\ &x_2(z)[P_{22}(x) + W_{21}(x)S_{p12}(z) + W_{22}(z)S_{p22}(z)] \end{aligned} \quad \text{[Eq. 6]}$$

Therefore, when the error signal $err_{h1}(n)$ output by the error correction adding unit 1117 of the first system becomes zero, the following equation is obtained.

$$\begin{aligned} err_{h1}(z) &= err_{p1}(z) + x_1(z)H_{11}(z) + x_2(z)H_{21}(z) = \\ &x_1(z)[P_{11}(z) + W_{11}(z)S_{p11} + W_{12}(z)S_{p21}(z)] + \\ &x_2(z)[P_{21}(x) + W_{21}(x)S_{p11}(z) + W_{22}(z)S_{p21}(z)] + \\ &x_1(z)H_{11}(z) + x_2(z)H_{21}(z) = 0 \end{aligned} \quad \text{(Eq. 7)}$$

Similarly, when the error signal $err_{h2}(n)$ becomes zero, the following equation is obtained.

$$\begin{aligned} err_{h2}(z) &= err_{p2}(z) + x_1(z)H_{12}(z) + x_2(z)H_{22}(z) = \\ &x_1(z)[P_{12}(z) + W_{11}(z)S_{p12}(z) + W_{12}(z)S_{p22}(z)] + \\ &x_2(z)[P_{22}(x) + W_{21}(x)S_{p12}(z) + W_{22}(z)S_{p22}(z)] + \\ &x_1(z)H_{12}(z) + x_2H_{22} = 0 \end{aligned} \quad \text{[Eq. 8]}$$

Here, as $x_1(z) \neq 0$ and $x_2(z) \neq 0$, the following equations can be obtained when $err_{h1}(z)$=zero and $err_{h2}(z)$=zero.

$$H_{11}(z)=[P_{11}(z)+W_{11}(z)S_{p11}(z)+W_{12}(z)S_{p21}(z)]$$

$$H_{12}(z)=[P_{12}(z)+W_{11}(z)S_{p12}(z)+W_{12}(z)S_{p22}(z)]$$

$$H_{21}(z)=[P_{21}(z)+W_{21}(z)S_{p11}(z)+W_{22}(z)S_{p21}(z)]$$

$$H_{22}(z)=[P_{22}(z)+W_{21}(z)S_{p12}(z)+W_{22}(z)S_{p22}(z)] \quad \text{[Eq. 9]}$$

By substituting the transfer functions $W_{11}(z)$, $W_{12}(z)$, $W_{21}(z)$, and $W_{22}(z)$ that are obtained in the first step learning process and that are set in the first fixed filter 61 of the first system, the first fixed filter 62 of the second system, the second fixed filter 63 of the first system, and the second fixed filter 64 of the second system, in the equation above, the following equations are obtained.

$$H_{11}(z)=-[P_{11}(z)+[V_{12}(z)S_{v21}(z)-V_{11}(z)S_{v22}(z)]S_{p11}(z)+[V_{11}(z)S_{v12}(z)-V_{12}(z)S_{v11}(z)]S_{p21}(z)]/[S_{v11}(z)S_{v22}(z)-S_{v12}(z)S_{v21}(z)]$$

$$H_{12}(z)=-[P_{12}(z)+[V_{12}(z)S_{v21}(z)-V_{11}(z)S_{v22}(z)]S_{p12}(z)+[V_{11}(z)S_{v12}(z)-V_{12}(z)S_{v11}(z)]S_{p22}(z)]/[S_{v11}(z)S_{v22}(z)-S_{v12}(z)S_{v21}(z)]$$

$$H_{21}(z)=-[P_{21}(x)+[V_{22}(z)S_{v21}(z)-V_{21}(z)S_{v22}(z)]S_{p11}(z)+[V_{21}(z)S_{v12}(z)-V_{22}(z)S_{v11}(z)]S_{p21}(z)]/[S_{v11}(z)S_{v22}(z)-S_{v12}(z)S_{v21}(z)]$$

$$H_{22}(z)=-[P_{22}(z)+[V_{22}(z)S_{v21}(z)-V_{21}(z)S_{v22}(z)]S_{p12}(z)+[V_{21}(z)S_{v12}(z)-V_{22}(z)S_{v11}(z)]S_{p22}(z)]/[S_{v11}(z)S_{v22}(z)-S_{v12}(z)S_{v21}(z)] \quad \text{[Eq. 10]}$$

In the second learning processing unit 60, the transfer functions $H_{11}(z)$, $H_{12}(z)$, $H_{21}(z)$, and $H_{22}(z)$ converge to these values.

When the transfer functions $H_{11}(z)$, $H_{12}(z)$, $H_{21}(z)$, and $H_{22}(z)$, that have converged in the second step learning process using the second learning processing unit 60, are obtained, the second step learning process is terminated.

Here, the transfer functions $H_{11}(z)$ and $H_{12}(z)$ obtained in a manner described above correct differences in the transfer functions of the noise signals $x_1(n)$ and $x_2(n)$, and the cancellation signals CA1(*n*) and CA2(*n*) to the first cancel point and to the position of the microphone 112L. Similarly, the transfer functions $H_{21}(z)$ and $H_{22}(z)$ that are obtained in a manner described above correct differences in the transfer functions of the noise signals $x_1(n)$ and $x_2(n)$, and the cancellation signals CA1(*n*) and CA2(*n*) to the second cancel point and the position of the microphone 112R.

The transfer functions $H_{11}(z)$, $H_{12}(z)$, $H_{21}(z)$, and $H_{22}(z)$ obtained by the above-described learning process correspond to the "setting values of the auxiliary filters" according to the present embodiment as described above. Further, the first auxiliary filter 1111 of the first system, the first auxiliary filter 1112 of the second system, the second auxiliary filter 1121 of the first system, and the second auxiliary filter 1122 of the second system correspond to the "auxiliary filter" of the present embodiment as described above.

By applying the "setting values of the auxiliary filters" to the "auxiliary filters", the noise generated by the first noise source 201 and the noise generated by the second noise source 202 can be canceled, for example, at the first cancel point and the second cancel point of FIG. 2.

The noise reduction device 100 performs the above-described learning process while the speakers and the microphones corresponding to the rear seats 103 and 104 affecting the noise in the driver seat 101 are enabled, and stores the obtained setting values of the auxiliary filters in advance as the setting values of the auxiliary filters A, for example. Furthermore, the noise reduction device 100 performs the above-described learning process while the speakers and microphones corresponding to either the rear seat 103 or the rear seat 104 affecting the noise in the driver seat 101 are disabled, and stores the obtained setting values of the auxiliary filters in advance as the setting values of the auxiliary filters B.

Preferably, the noise reduction device 100 previously stores the setting values of the auxiliary filters A and the auxiliary filters B obtained by a similar learning process for each of the other seats in the vehicle 10.

The embodiment of the present invention has been described above, but the present invention is not limited to the embodiment described above. The various modifications and alterations can be made within the spirit and scope of the invention described in the claims.

What is claimed is:

1. A noise reduction device using a speaker and a microphone corresponding to each seat in a vehicle to reduce a noise in each seat, the noise reduction device comprising:

a memory; and a processor coupled to the memory and configured to:

generate a canceling sound that reduces a noise at an ear of an occupant in a predetermined seat by using an auxiliary filter;

disable operations of a speaker and a microphone corresponding to each empty seat in the vehicle; and change a setting value of the auxiliary filter to generate the canceling sound in accordance with a number of occupants in seats other than the predetermined seat, the seats affecting the noise in the predetermined seat, wherein when the occupant rides in the predetermined seat, the processor sets a setting value of the auxiliary filter to generate the canceling sound in accordance with the number of occupants in the seats other than the predetermined seat, and the processor enables an operation of a speaker corresponding to the predetermined seat and, after the processor has enabled the operation of the speaker or when the processor enables the operation of the speaker, the processor enables an operation of a microphone corresponding to the predetermined seat.

2. The noise reduction device as claimed in claim 1, wherein the processor sets a setting value of the auxiliary filter to the auxiliary filter used to generate the canceling sound when the occupant is present in each of the seats other than the predetermined seat, the setting value of the auxiliary filter being learned while operations of a speaker and a microphone corresponding to each of the seats other than the predetermined seat are enabled.

3. The noise reduction device as claimed in claim 2, wherein the processor sets a setting value of the auxiliary filter to the auxiliary filter to generate the canceling sound when the occupant is present in either of the seats other than the predetermined seat, the setting value of the auxiliary filter being learned while, among the seats other than the predetermined seat, operations of a speaker and a microphone corresponding to one seat are enabled and operations of a speaker and a microphone corresponding to another seat are disabled.

4. The noise reduction device as claimed in claim 1, wherein the predetermined seat includes a first speaker and a first microphone provided near a left ear of the occupant, and a second speaker and a second microphone provided near a right ear of the occupant, and wherein the processor generates a first canceling sound that reduces a noise at the left ear of the occupant and a second canceling sound that reduces a noise at the right ear of the occupant.

5. The noise reduction device as claimed in claim 1, wherein the predetermined seat is a driver seat or a passenger seat in the vehicle, and wherein the seats other than the predetermined seat are rear seats in the vehicle.

6. The noise reduction device as claimed in claim 1, wherein the predetermined seat is one of rear seats in the vehicle, and wherein the seats other than the predetermined seat are a driver seat and a passenger seat in the vehicle.

7. A vehicle to which the noise reduction device as claimed in claim 1 is mounted.

8. A noise reduction system using a speaker and a microphone corresponding to each seat in a vehicle to reduce a noise in each seat, the noise reduction system comprising:

a memory; and a processor coupled to the memory and configured to:

generate a canceling sound that reduces a noise at an ear of an occupant in a predetermined seat by using an auxiliary filter;

disable operations of a speaker and a microphone corresponding to each empty seat in the vehicle; and change a setting value of the auxiliary filter to generate the canceling sound in accordance with a number of occupants in seats other than the predetermined seat, the seats affecting the noise in the predetermined seat wherein when the occupant rides in the predetermined seat, the processor sets a setting value of the auxiliary filter to generate the canceling sound in accordance with the number of occupants in the seats other than the predetermined seat, and the processor enables an operation of a speaker corresponding to the predetermined seat and, after the processor has enabled the operation of the speaker or when the processor enables the operation of the speaker, the processor enables an operation of a microphone corresponding to the predetermined seat.

9. A noise reduction method performed by a noise reduction system using a speaker and a microphone corresponding to each seat in a vehicle to reduce a noise in each seat, the noise reduction method comprising:

generating a canceling sound that reduces a noise at an ear of an occupant in a predetermined seat by using an auxiliary filter;

disabling operations of a speaker and a microphone corresponding to each empty seat in the vehicle;

changing a setting value of the auxiliary filter to generate the canceling sound in accordance with a number of occupants in seats other than the predetermined seat, the seats affecting the noise in the predetermined seat; and setting, when the occupant rides in the predetermined seat, a setting value of the auxiliary filter to generate the canceling sound in accordance with the number of occupants in the seats other than the predetermined seat, and enabling an operation of a speaker corresponding to the predetermined seat and, after the operation of the speaker is enabled or when the operation of the speaker is enabled, enabling an operation of a microphone corresponding to the predetermined seat.

* * * * *